US011655075B2

(12) United States Patent
Ramsuer et al.

(10) Patent No.: US 11,655,075 B2
(45) Date of Patent: May 23, 2023

(54) DISPENSING SYSTEMS AND METHODS FOR USING THE SAME

(71) Applicant: Silgan Dispensing Systems Corporation, Grandview, MO (US)

(72) Inventors: Brandon L. Ramsuer, Henrico, VA (US); Kelly A. Harrigan, Richmond, VA (US); Niels F. G. Van Wieringen, 's-Hertogenbosch (NL); Stefan Koster, Rotterdam (NL); Eelco Han De Man, Vlijmen (NL); Sara D. Falcon, Richmond, VA (US); William L. Driskell, Lee's Summit, MO (US)

(73) Assignee: Silgan Dispensing Systems Corporation, Grandview, MO (US)

( * ) Notice: Subject to any disclaimer, the term of this patent is extended or adjusted under 35 U.S.C. 154(b) by 121 days.

(21) Appl. No.: 17/074,537

(22) Filed: Oct. 19, 2020

(65) Prior Publication Data

US 2021/0031982 A1 Feb. 4, 2021

Related U.S. Application Data

(63) Continuation of application No. 16/074,503, filed as application No. PCT/US2017/015936 on Feb. 1, 2017, now Pat. No. 10,807,769.

(Continued)

(51) Int. Cl.

| | |
|---|---|
| ***B65D 25/42*** | (2006.01) |
| ***B65D 1/02*** | (2006.01) |
| ***B65D 25/40*** | (2006.01) |
| ***D06F 39/02*** | (2006.01) |
| ***B65D 25/00*** | (2006.01) |
| ***B65D 25/38*** | (2006.01) |
| ***B65D 23/00*** | (2006.01) |
| ***B65D 1/12*** | (2006.01) |
| ***B65D 25/52*** | (2006.01) |

(Continued)

(52) U.S. Cl.

CPC ..... *B65D 25/42* (2013.01); *B65D 1/02* (2013.01); *B65D 1/12* (2013.01); *B65D 23/00* (2013.01); *B65D 25/00* (2013.01); *B65D 25/38* (2013.01); *B65D 25/40* (2013.01); *B65D 25/52* (2013.01); *B65D 41/265* (2013.01); *B67D 3/043* (2013.01); *D06F 39/022* (2013.01); *D06F 39/024* (2013.01)

(58) Field of Classification Search

CPC ... B65D 1/02; B65D 1/12; B65D 1/32; B65D 5/16; B65D 7/40; B65D 41/265; B65D 25/42; B65D 25/52; B65D 25/40; B65D 25/38; B65D 25/00; B65D 23/00; B67D 3/043; D06F 39/02; D06F 39/022

USPC ..... 141/113, 114, 351

See application file for complete search history.

(56) References Cited

U.S. PATENT DOCUMENTS

| | | | |
|---|---|---|---|
| 629,327 | A | 7/1899 | Barger |
| 1,062,118 | A | 5/1913 | Ritten |

(Continued)

FOREIGN PATENT DOCUMENTS

| | | | |
|---|---|---|---|
| DE | 10331703 | A1 | 1/2005 |
| EP | 2005871 | B1 | 3/2016 |

*Primary Examiner* — Timothy L Maust

(74) *Attorney, Agent, or Firm* — Hinckley, Allen & Snyder, LLP; Stephen Holmes

(57) ABSTRACT

Dispensing systems for delivering a product from the inside of a container to a receptacle, cup, or container include valve systems and other dispensing configurations to reduce mess, parts, and costs associated with such dispensing systems.

15 Claims, 21 Drawing Sheets

Related U.S. Application Data

(60) Provisional application No. 62/337,051, filed on May 16, 2016, provisional application No. 62/290,573, filed on Feb. 3, 2016, provisional application No. 62/290,142, filed on Feb. 2, 2016.

(51) Int. Cl.
*B65D 41/26* (2006.01)
*B67D 3/04* (2006.01)

(56) References Cited

U.S. PATENT DOCUMENTS 1,066,178 A 7/1913 Bonnell
2,197,352 A 1/1938 Terkel
2,311,367 A * 2/1943 Chambers ..... B65D 47/42 401/187
2,699,885 A * 1/1955 Mcclure ..... B65D 47/248 222/476
2,702,563 A 2/1955 Snyder et al.
3,066,819 A 12/1962 Cox
3,180,538 A * 4/1965 Brown ..... D06F 39/024 251/75
3,187,965 A 6/1965 Bourget
3,251,514 A 5/1966 Speicher
3,434,635 A 3/1969 Mason, Jr.
3,489,322 A 1/1970 Ayres
3,752,366 A * 8/1973 Lawrence, Jr. ..... F04B 53/1092 222/335
3,753,518 A 8/1973 Kutik
3,834,594 A 9/1974 Schiemann
3,888,391 A * 6/1975 Merz ..... D06F 39/024 222/500
T993,001 I4 * 4/1980 McCarthy ..... D06F 39/024 68/17 R
4,212,332 A 7/1980 Kutik et al.
4,327,782 A * 5/1982 McKibben ..... G01F 11/082 141/369
4,330,071 A * 5/1982 Ohlson ..... G01F 11/082 222/207
4,412,633 A 11/1983 Guerrazzi et al.
4,452,425 A 6/1984 Lucking
4,664,297 A 5/1987 Giovinazzi
4,715,516 A 12/1987 Salvail
4,722,463 A 2/1988 Anderson
4,762,475 A 8/1988 Fuchs
4,838,464 A 6/1989 Briggs
4,875,600 A * 10/1989 D'Hoogue ..... B65D 41/26 222/454
4,877,159 A 10/1989 Strand
5,024,353 A 6/1991 Horne
5,102,017 A 4/1992 Dirksing
5,133,482 A 7/1992 Burrows et al.
5,211,314 A 5/1993 Burrows
5,271,372 A 12/1993 Nuti
5,330,080 A 7/1994 O'Connor
5,346,106 A 9/1994 Ring
5,355,541 A * 10/1994 Rutter ..... D06F 39/024 510/303
5,358,152 A * 10/1994 Banks ..... G01F 11/263 222/521
5,405,058 A 4/1995 Kalis et al.
5,406,994 A 4/1995 Mitchell et al.
5,489,044 A 2/1996 Ophardt
5,538,165 A 7/1996 Frohn
5,711,355 A 1/1998 Kowalczyk
5,746,358 A 5/1998 Crosby
5,768,918 A * 6/1998 McKibben ..... D06F 39/024 68/17 R
5,897,035 A 4/1999 Schlomer
6,029,858 A 2/2000 Srokose et al.
6,082,593 A 7/2000 Borcherds
6,155,464 A 12/2000 Vachon
6,360,924 B1 3/2002 Franzen
6,401,752 B1 6/2002 Blackbourn et al.
6,502,725 B1 1/2003 Alexander
6,527,145 B1 3/2003 Bennett, Jr.
6,547,105 B1 * 4/2003 Seelhofer ..... G01F 11/082 222/211
6,574,883 B2 * 6/2003 Giblin ..... D06F 39/024 68/17 R
6,631,744 B1 10/2003 Gerhart et al.
6,672,485 B2 1/2004 Mascitelli
7,086,548 B2 8/2006 Bartlett
7,198,175 B2 4/2007 Ophardt
7,325,706 B2 2/2008 Sweeten et al.
7,377,296 B2 * 5/2008 Gueret ..... A45D 34/042 401/125
7,490,743 B2 2/2009 Herzog
7,757,900 B2 7/2010 Knauer et al.
7,793,803 B2 9/2010 Neerinex et al.
7,959,044 B1 6/2011 Christian et al.
8,091,743 B2 1/2012 Lester et al.
8,245,736 B2 * 8/2012 Geerse ..... A47G 19/34 141/2
8,313,008 B2 * 11/2012 Ciavarella ..... B05B 11/3052 239/323
8,360,287 B2 * 1/2013 Ciavarella ..... A47K 5/1208 239/338
8,402,999 B2 3/2013 Nini
8,464,917 B2 6/2013 Nini
8,550,131 B1 * 10/2013 Shenkman ..... B65B 1/36 141/2
8,579,159 B2 * 11/2013 Ciavarella ..... A47K 5/1208 222/190
9,096,357 B2 8/2015 Brausen
9,681,731 B2 6/2017 Jo et al.
9,827,581 B2 11/2017 Sood et al.
9,839,929 B2 12/2017 DeMan
9,878,834 B2 1/2018 Azelton et al.
10,228,272 B2 3/2019 A Moreno Aparicio et al.
10,266,315 B2 4/2019 Kieras et al.
10,315,910 B2 6/2019 Boucher et al.
10,335,814 B2 7/2019 Lang et al.
10,421,090 B2 9/2019 DeJong et al.
10,526,191 B1 1/2020 Driskell et al.
10,618,069 B2 4/2020 Goettke
2001/0054628 A1 12/2001 Harbaugh et al.
2005/0145634 A1 7/2005 Giblin et al.
2008/0210658 A1 9/2008 Jo
2009/0140009 A1 6/2009 Chen
2009/0212077 A1 8/2009 Carden
2010/0096415 A1 4/2010 Dennis
2011/0084099 A1 4/2011 Carta
2011/0108581 A1 5/2011 Dennis
2013/0008919 A1 1/2013 Honan et al.
2013/0146174 A1 * 6/2013 Zinn ..... B65B 3/045 141/2
2014/0305971 A1 10/2014 Goettke
2016/0059254 A1 3/2016 De Roo
2016/0332181 A1 11/2016 DeMan
2017/0247239 A1 8/2017 Nini
2018/0049773 A1 2/2018 Backes
2018/0186522 A1 7/2018 Kieras et al.
2019/0186971 A1 6/2019 Moreno Aparicio et al.
2022/0024648 A1 * 1/2022 Klien ..... B65D 41/04

* cited by examiner

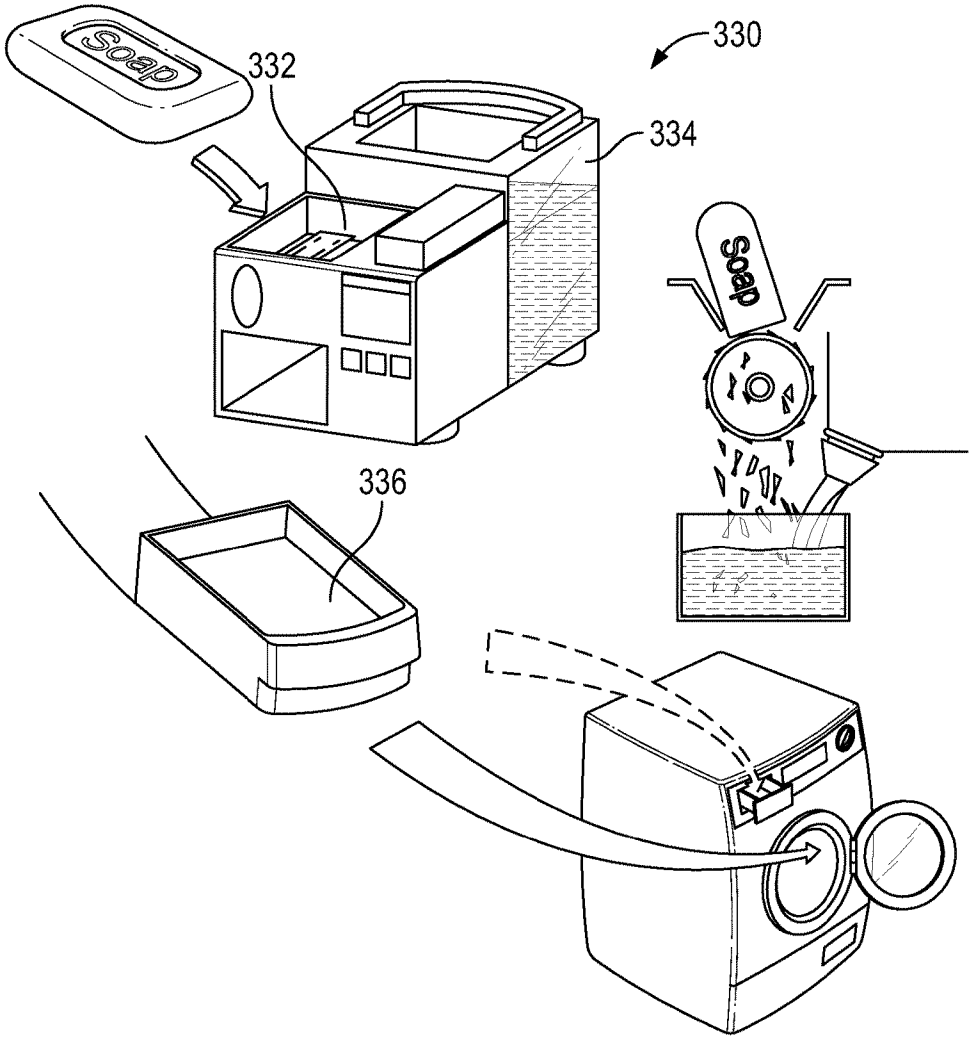
FIG. 27
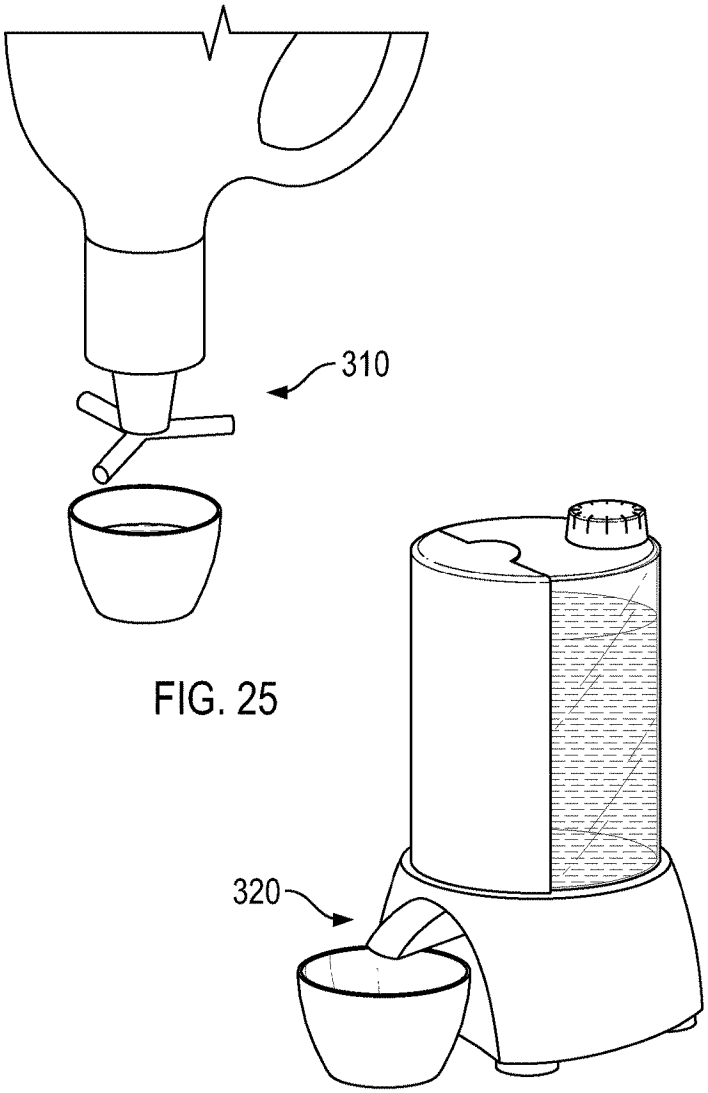
FIG. 25
FIG. 26

DISPENSING SYSTEMS AND METHODS FOR USING THE SAME

CROSS-REFERENCE TO RELATED APPLICATIONS

This application is a continuation of U.S. application Ser. No. 16/074,503, filed Aug. 1, 2018, which is a U.S. National Stage Filing of PCT/US2017/015963, filed Feb. 1, 2017, which claims the benefit of each of U.S. Provisional Application No. 62/290,142 filed Feb. 2, 2016, Provisional Application No. 62/290,573 filed Feb. 3, 2016, and Provisional Application No. 62/337,051, filed May 16, 2016, the entire contents of each being incorporated herein by reference.

BACKGROUND OF THE INVENTION

Field of the Invention

Embodiments of the invention relate to dispensers and more particularly to dispensers for pumping or gravity feeding viscous fluids into a container for distribution or use.

State of the Art

Dispensing devices are widely used for many different products. In the field of laundry care, liquid laundry detergent is often dispensed from a large container into a smaller container or measuring device before being added to a load of laundry. For example, the press-tap system is a common feature used with laundry dispensing systems. The press-tap feature consists of a press-tap valve that, when pressed, allows laundry detergent to flow under gravitational forces through the open valve into a cup or dispenser being held underneath the press-tap output opening. Releasing the press-tap stops the flow of product therethrough.

While press-tap systems are widely used with laundry products, they are not ideal. In fact, press-tap systems are not always preferred by users and consumers for a number of reasons, including, among others, leakage, force to actuate issues, messiness, complexity, and number of steps required to complete dosing. Thus, there exists a need for better dispensing systems and methods for using such, especially for use with liquid laundry products.

BRIEF DESCRIPTION OF THE DRAWINGS

While the specification concludes with claims particularly pointing out and distinctly claiming particular embodiments of the present invention, various embodiments of the invention can be more readily understood and appreciated by one of ordinary skill in the art from the following descriptions of various embodiments of the invention when read in conjunction with the accompanying drawings in which:

FIG. 25 illustrates a dispensing system according to various embodiments of the invention;

FIG. 26 illustrates a dispensing system according to various embodiments of the invention;

FIG. 27 illustrates a dispensing system according to various embodiments of the invention;

DETAILED DESCRIPTION OF THE INVENTION

Figure 2:
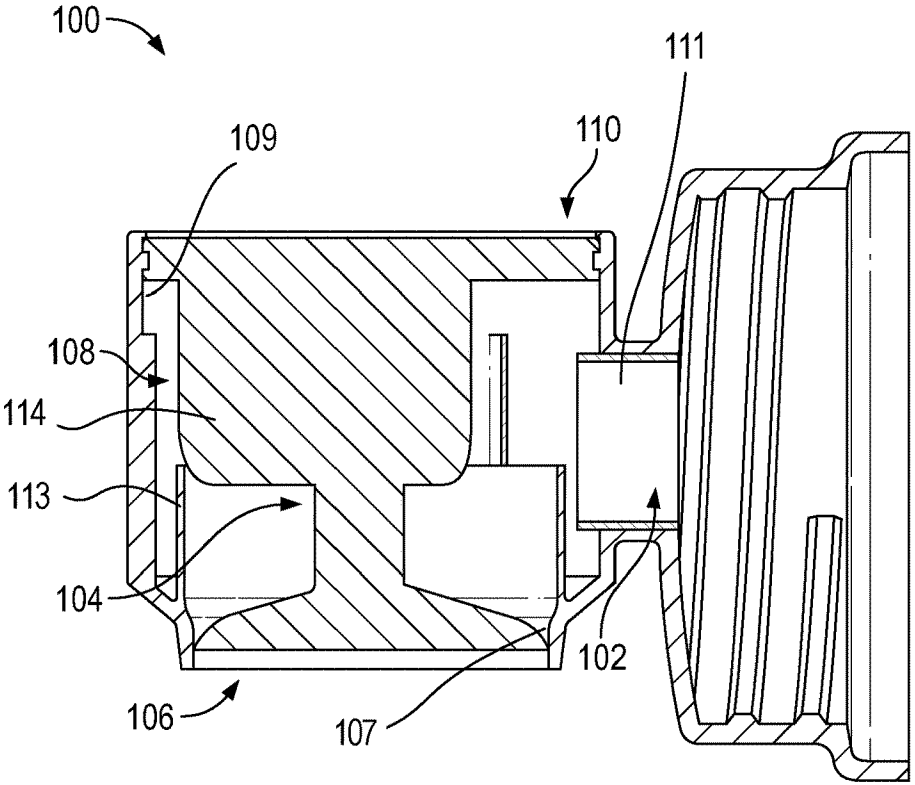
FIG. 2 illustrates a cross-sectional view of a two-piece dispensing system according to various embodiments of the invention.
Figure 1:
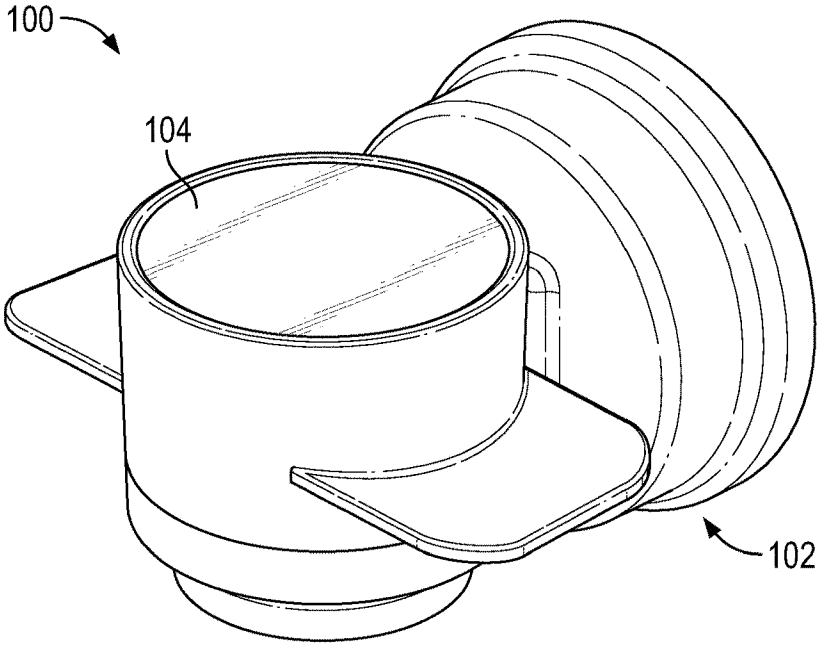
FIG. 1 illustrates a two-piece dispensing system according to various embodiments of the invention.

According to various embodiments of the invention, a two-piece dispensing system 100 includes a body 102 and a valve 104 as illustrated in FIGS. 1 and 2. As shown in FIG. 2, the valve 104 rests within or is assembled with a cavity in the body 102. The valve 104 includes a stop 106, an integrated cup-spring 108, and an actuation button 110. The stop 106 forms a liquid tight seal with an interior wall of the body 102 cavity adjacent an output opening 107 (second opening) of the body 102. The actuation button 110 forms a seal with the body 102 wall within the cavity at a first opening 109 opposite the stop 106. As pressure or a force is applied to the actuation button 110, the cup-spring walls 113 may flex over projections 114 on the actuation button 110 within the cavity of the body 102 and the stop 106 is disengaged from the liquid tight seal with the interior of the body 102 walls such that fluid contained in a container to which the two-piece dispensing system 100 is attached may flow out of the container, through a container opening 111 in the body, through the cavity in the body 102, and past the stop 106 as desired. When the force on the actuation button 110 is released, the cup-spring 108 acts to move the valve 104 back into the original position with the stop 106 forming a liquid tight seal with the interior walls of the body 102.

A body 102 according to various embodiments of the invention may be attached to a container as desired. For example, as illustrated in FIG. 2, the body 102 may include threads to allow the body 102 to be screwed onto a container. In other embodiments, a snap-fit or bayonet system may be used to attach the body 102 to a container. A body 102 may also include wings or other features to assist with gripping the body 102 while applying a force to the actuation button 110 associated therewith.

In certain embodiments of the invention, the body 102 and valve 104 may be molded from a resin or plastic. In some embodiments, the body 102 and valve 104 may be made of the same material to facilitate recycling. In other embodiments, while the materials of the body 102 and valve 104 may be different, they may both be recyclable.

Figure 4:
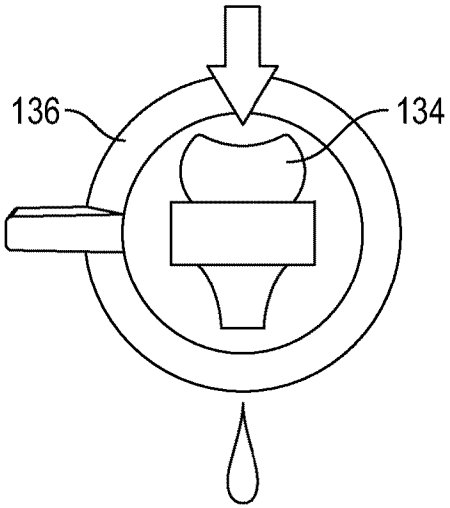
FIG. 4 illustrates a dispenser according to various embodiments of the invention in an open position.
Figure 5:
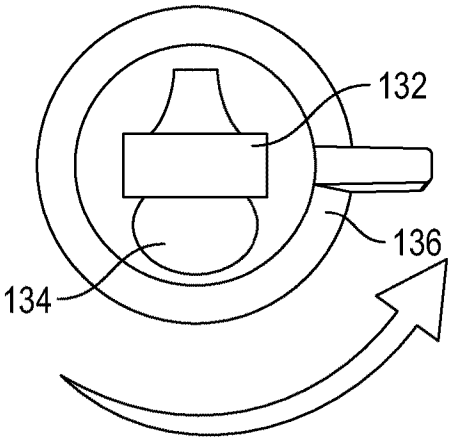
FIG. 5 illustrates a dispenser according to various embodiments of the invention in a closed position.
Figure 3:
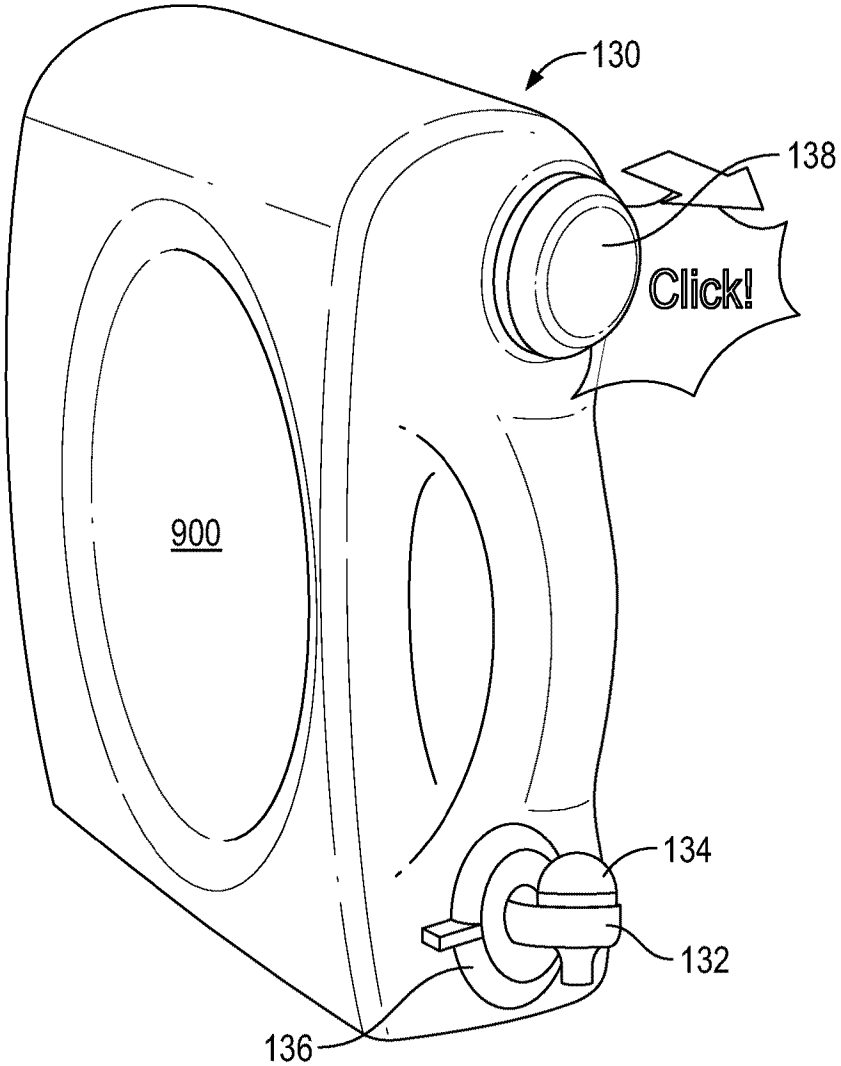
FIG. 3 illustrates a dispensing system according to various embodiments of the invention.

A dispensing system 130 according to other embodiments of the invention is illustrated in FIGS. 3 through 5. The dispensing system 130 may include a container 900 having a vent 138 attached to a first opening in the container 900 and a dispensing system attached to a second opening in the container 900. The dispensing system may include a body 132, a valve 134, and an on/off toggle 136. For example, the dispensing system may include a dispensing system 100 as illustrated in FIGS. 1 and 2 integrated with an on/off toggle 136. In other embodiments, the dispensing system may include a traditional body, valve, and spring system attached to an on/off toggle 136.

According to various embodiments of the invention, an on/off toggle 136 may include a rotatable component that can be rotated from a position where product is allowed to flow into the body 132—an "on" position—to a position where product is prevented from flowing from the container 900 into the body 132—an "off" position. Rotation of the on/off toggle 136 may be facilitated by a wing or projection extending off of the on/off toggle 136. For example, as illustrated in FIGS. 3 through 5, an on/off toggle 136 includes an arm extending outward from the on/off toggle 136 to allow a user the ability to more easily rotate the on/off toggle 136.

In some embodiments of the invention, rotation of the on/off toggle 136 may rotate the body 132 of the dispensing system as illustrated in FIGS. 4 and 5. Rotation of the body 132 allows the output opening of the body 132 to be pointed in an upward direction relative to the intended position of a container 900 on a shelf. In this position, extra liquid escaping the body 132 or flowing by the valve 134, will not drip, thereby preventing the dripping mess traditionally associated with such products.

In other embodiments of the invention, an on/off toggle 136 may rotate a component within the body 132 or between the body 132 and the container 900 opening such that fluid is stopped from flowing into the body 132 when the on/off toggle 136 is in the "off" position.

A dispensing system 130 according to various embodiments of the invention may also include a vent 138 attached to a first opening in the container 900 as illustrated in FIG. 3. The vent 138 may include a push/pull vent system that may be pulled outward, away from the container 900, to open the vent 138. In some embodiments, the vent 138 may also include an audible feature that makes a noise—such as a "click"—when the vent 138 is opened so that a user knows that the vent 138 is in an open state. Similarly, the vent 138 may be pushed towards the container 900 to close the vent 138. Again, an audible feature may make a noise to inform a user that they have successfully closed the vent 138.

Figure 6:
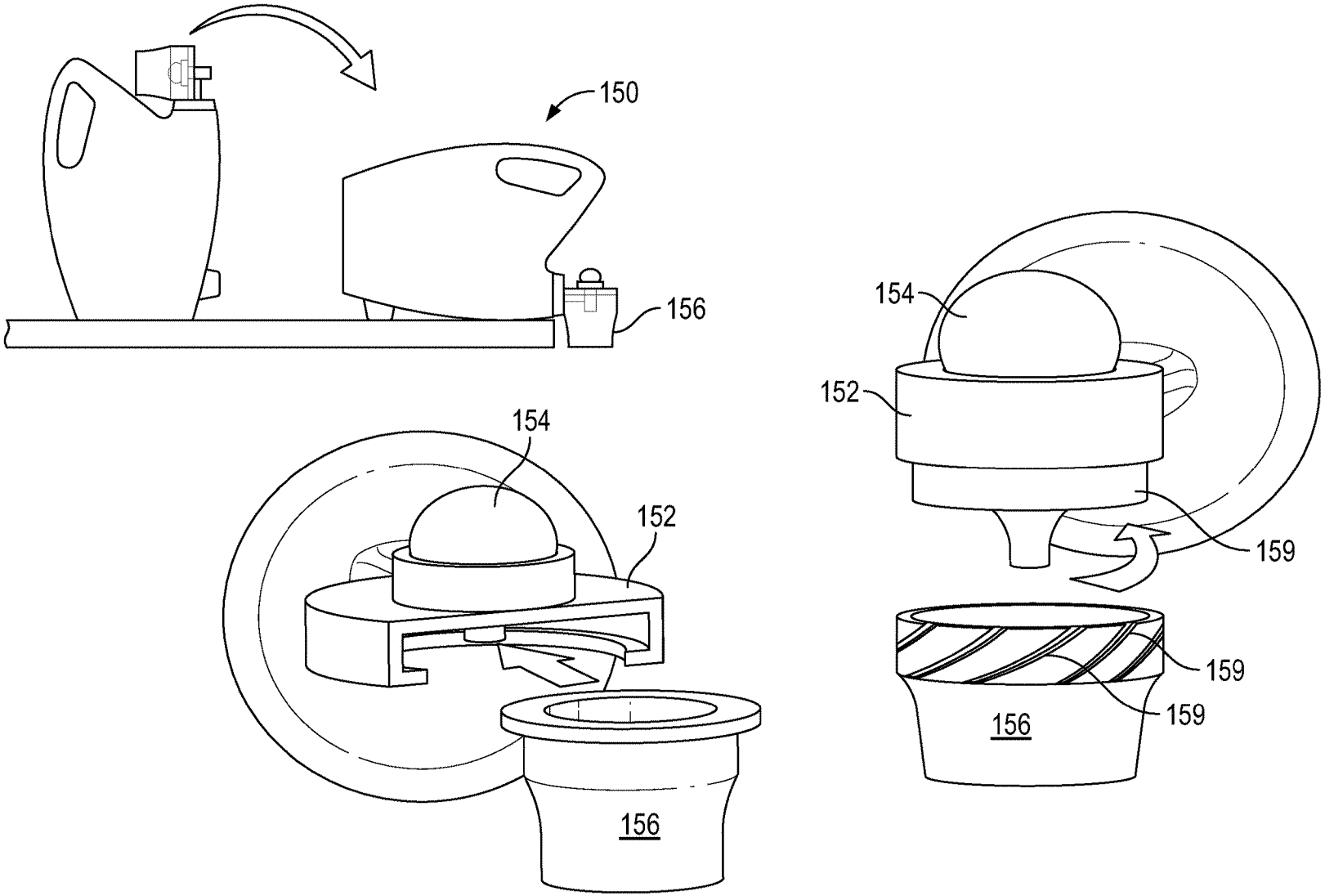
FIG. 6 illustrates a dispensing system according to various embodiments of the invention.

A dispensing system 150 according to still other embodiments of the invention is illustrated in FIG. 6. As illustrated, a dispensing system 150 may include a container 900, a body 152 and valve 154 attached to an opening in the container 900, and a cup 156 for collecting a product dispensed from the body 152 and valve 154. According to some embodiments of the invention, the cup 156 may slide into a body 152 shaped to receive the cup 156. For example, as illustrated, the cup 156 may include wings or a lip about the opening of the cup 156 and the body 152 may include one or more ledges configured to receive the lip about the cup 156 and hold or retain the cup 156 to the body for dispensing of a product into the cup 156. In other embodiments of the invention, a cup 156 may include a bayonet attachment or threads which may be used to attach the cup 156 to the body 152. For example, as illustrated in FIG. 6, in some embodiments, the body 152 and cup 156 may each include threads 159 to allow the cup 156 to be threaded onto the body 152 such that it may be retained in a position to be filled.

Figure 8B:
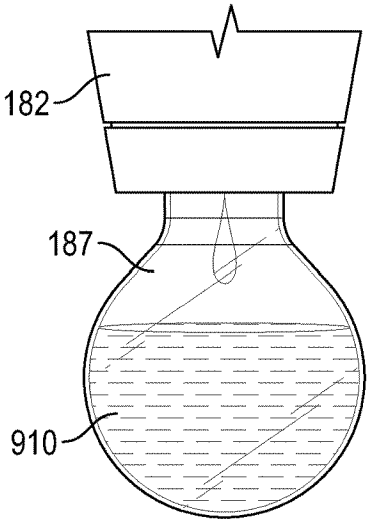
FIG. 8B illustrates a dispensing ball filled according to various embodiments of the invention.
Figure 8C:
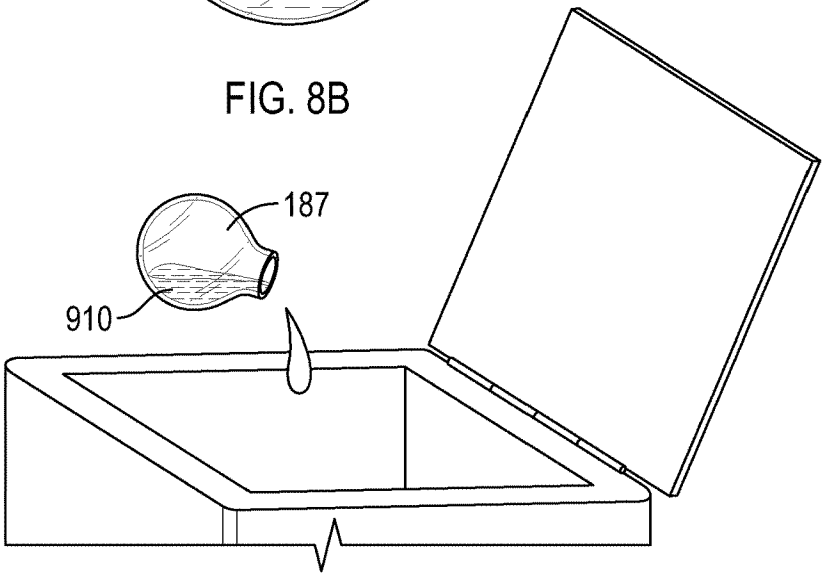
FIG. 8C illustrated a dispensing ball being used with a load of laundry according to various embodiments of the invention.
Figure 7:
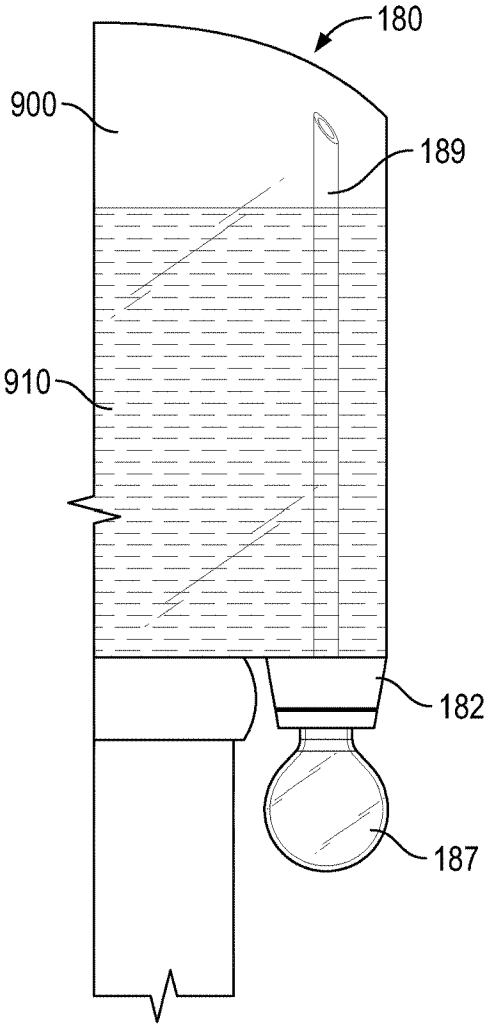
FIG. 7 illustrates a dispensing system according to various embodiments of the invention.

A dispensing system 180 according to still other embodiments of the invention is illustrated in FIGS. 7 through 8C. As illustrated in FIG. 7, a dispensing system 180 may include a container 900 having a product 910 contained therein. A body 182 may be attached to the container 900 about an opening therein. The body 182 may include a valve that may allow product to flow out of the container 900 into a dispensing ball 187, cup, or other receptacle. As illustrated in FIG. 7, a dip-tube 189 may also be configured with the body 182 to allow air to enter the container 900 for venting.

Figure 8A:
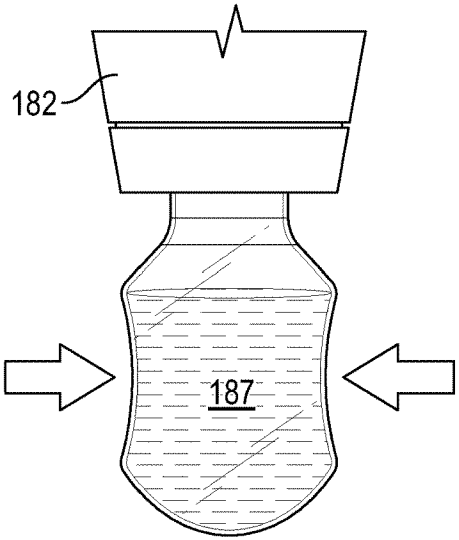
FIG. 8A illustrates a dispensing ball being actuated according to various embodiments of the invention.

FIGS. 8A through 8C illustrate the use of the dispensing system 180. As shown in FIG. 8A, a dispensing ball 187 made of a flexible material may be attached to the body 182. A user may squeeze the dispensing ball 187 to evacuate air into the container 900 through the clip tube 189. A vacuum formed on an interior of the dispensing ball 187 may pull product 910 from the container 900 through the valve in the body 182 and into an interior space of the dispensing ball 187 as illustrated in FIG. 8B. The dispensing ball 187 may be dislodged from the body 182 and the product 910 poured from the dispensing ball 187 into a washing machine or other desired location as illustrated in FIG. 8C.

Figure 30:
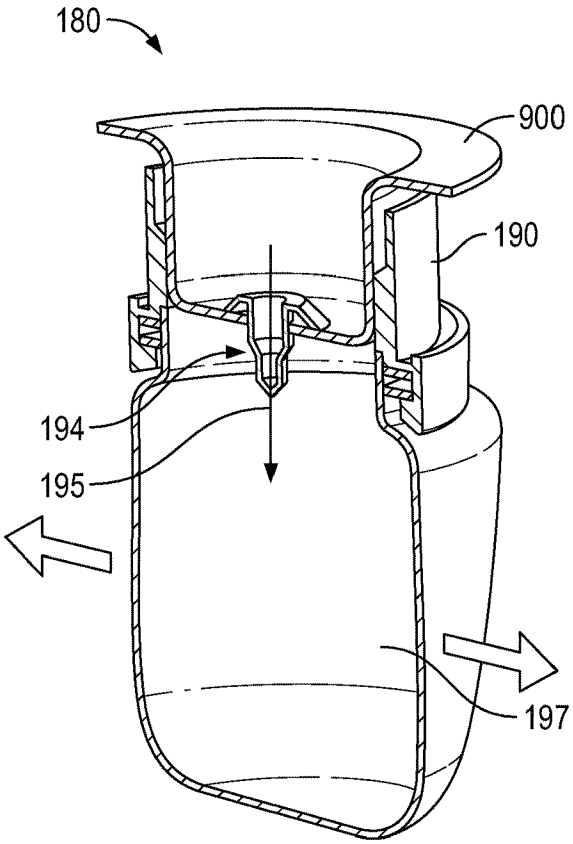
FIG. 30 illustrates a dispensing system according to various embodiments of the invention.
Figure 29:
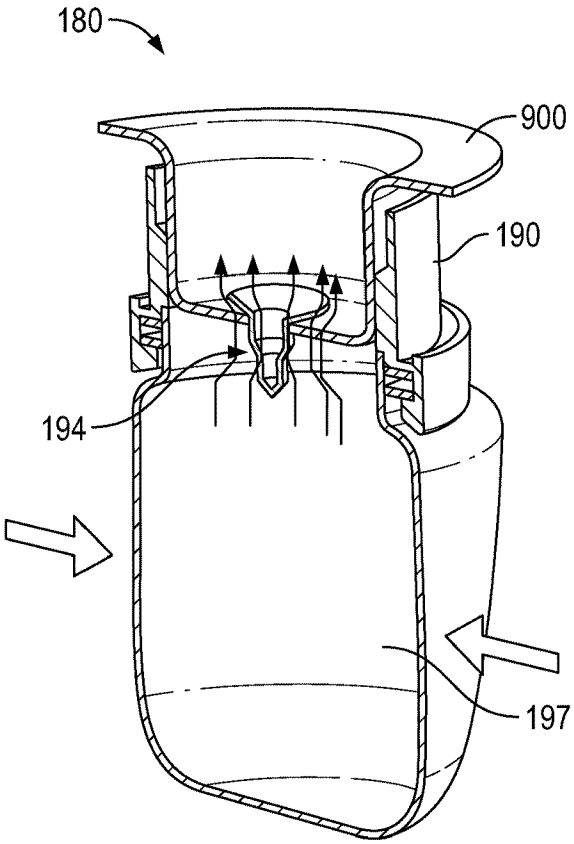
FIG. 29 illustrates a dispensing system according to various embodiments of the invention.
Figure 28:
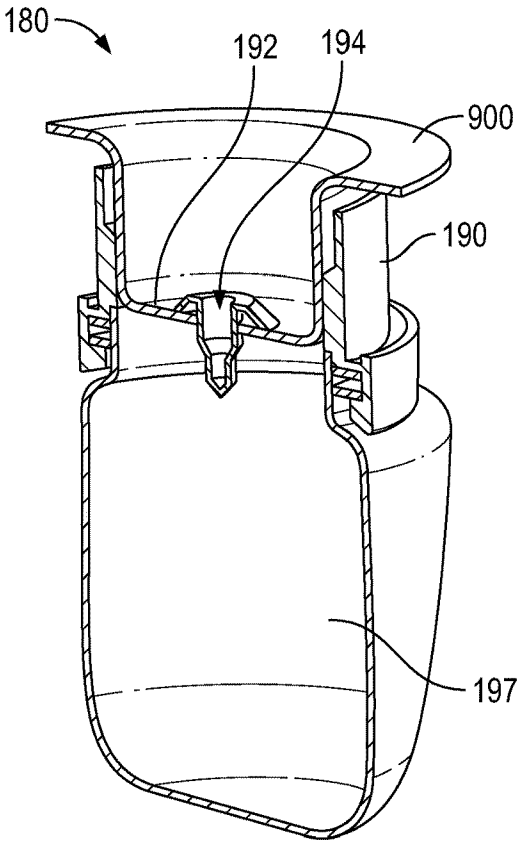
FIG. 28 illustrates a dispensing system according to various embodiments of the invention.

An alternative version of the dispensing system 180 according to various embodiments of the invention is illustrated in FIGS. 28 through 30. As illustrated, the dispensing system 180 may include a body 190 attached to an opening of a container 900. The body 190 may include a wall 192 spanning the opening of the container 900. A hole in the wall may be filled by a valve 194 as illustrated in FIG. 28. The body 192 may also include a dispensing ball attachment system 195. For example, as illustrated, a dispensing ball 197 may include threads to allow the dispensing ball 197 to be screwed onto the body 192. The dispensing ball 197 may be made of a flexible material.

As illustrated in FIG. 29, when the dispensing ball 197 is squeezed or a forced is applied to the walls of the dispensing ball 197 to deform them, air from within the dispensing ball 197 is forced through the hole in the wall 192, past a feature of the valve 194. As illustrated in FIG. 29, the valve 194 may include a flexible, conical membrane that may flex when air is forced out of the dispensing ball 197, allowing air to enter the container 900. Once the force is removed from the dispensing ball 197, the walls return to their normal position. A vacuum created in the dispensing ball 197 pulls product 910 from the container 900 through an internal channel 195 in the valve 194. The product 910 fills a portion of the volume in the dispensing ball 197 as illustrated in FIG. 30. Once the desired amount of product 910 is contained in the dispensing ball 197, it may be removed from the body 192 and the contents poured out or distributed as desired.

Figure 9:
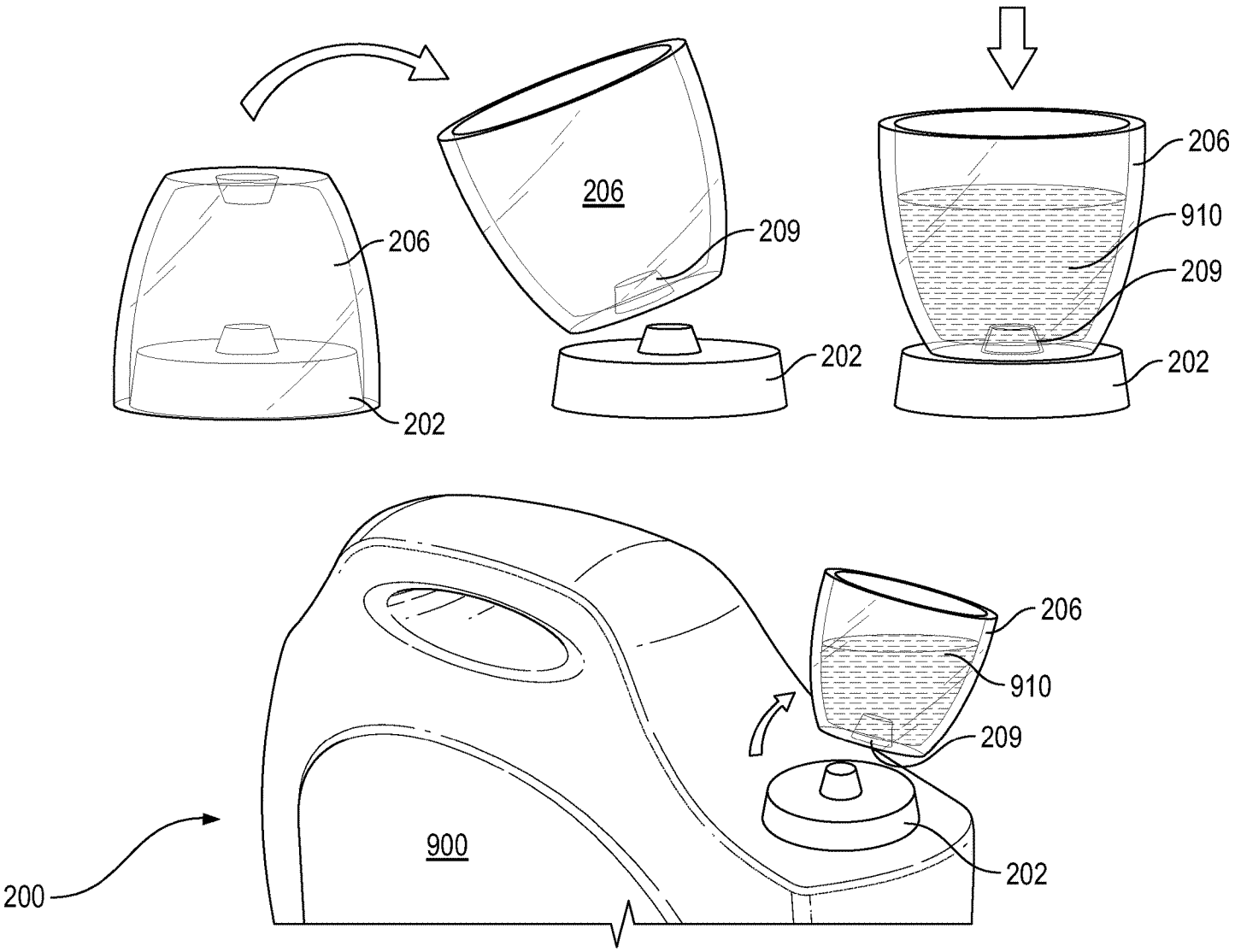
FIG. 9 illustrates a dispensing system according to various embodiments of the invention.

A dispensing system 200 according to other embodiments of the invention is illustrated in FIG. 9. The dispensing system 200 includes a container 900 having a body 202 attached to an opening in the container 900, the body 202 having a pump associated therewith. A cap 206 or cup having an open end and a valved end opposite the open end may be attached to or fitted to the body 202 for retail shipment such that the open end is attached to the body 202. To use the dispensing system 200, the cap 206 may be removed from its storage position and inverted so that the valved end of the cap 206 may be placed on or mated with the body 202. The valved end may include a valve 209 or one-way opening that allows product 910 to pass into the cap 206. For example, the cap 206 may be inverted and placed on the body 202 such that the valve 209 aligns with an opening to a pump or valve associated with the body 202. Engagement of the valve 209 with the body 202 may fill the cap 206. In some embodiments, the body 202 may include a moveable platform or membrane that engages the cap 206 such that when the cap 206 and valve 209 are pushed against the body 202, product 910 is pumped from within the container 900 into the cap 206 as illustrated in FIG. 9.

Figure 12:
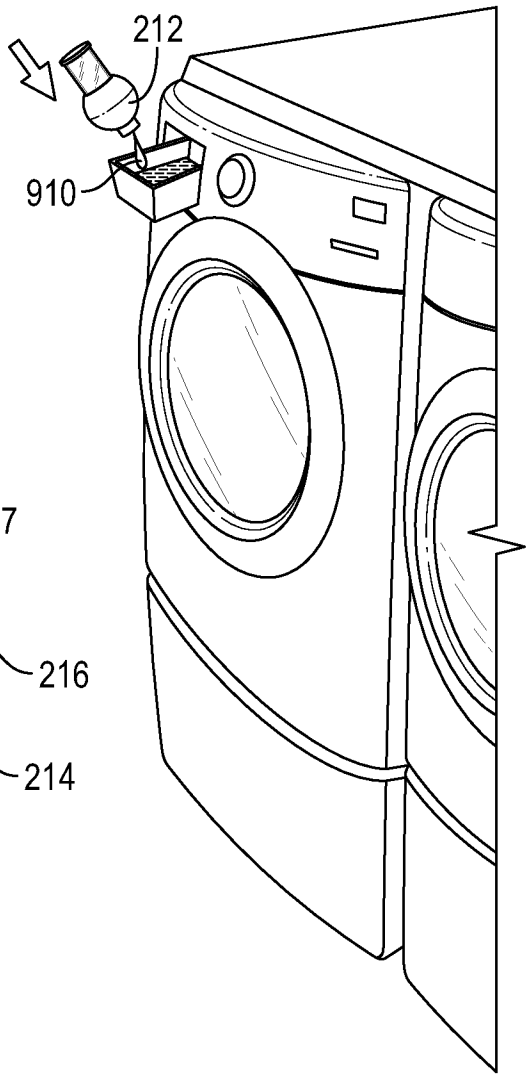
FIG. 12 illustrates a dispenser according to various embodiments of the invention.
Figure 11:
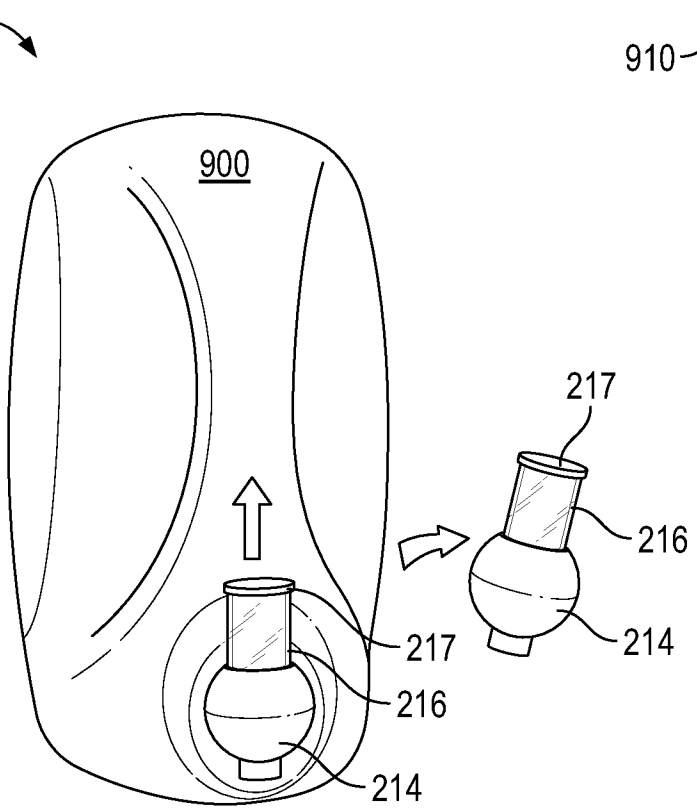
FIG. 11 illustrates the dispensing system of FIG. 10 in use.
Figure 10:
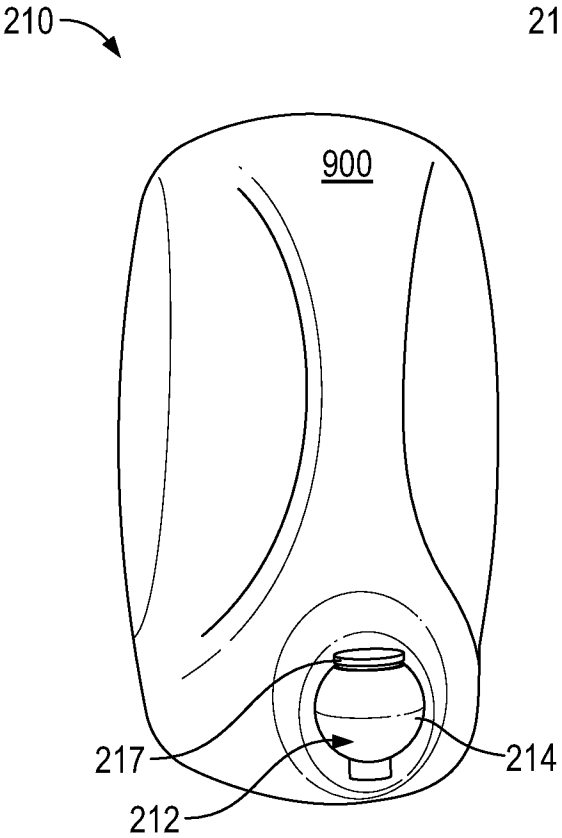
FIG. 10 illustrates a dispensing system according to various embodiments of the invention.

A dispensing system 210 according to still other embodiments of the invention is illustrated in FIGS. 10 through 12. As illustrated, the dispensing system 210 may include a container 900 and a dispenser 212. The dispenser 212 may include a base 214 and a plunger 216 as illustrated. The base 214 may include a cavity in which the plunger 216 is moveably seated. The plunger 216 may be inserted in an opening in one end of the base 214 and may include a cap 217 that can be pulled or pushed by a user to move the plunger 216 within the base 214. A one-way valve opposite the end into which the plunger 216 is inserted may prevent flow of product 910 out of the cavity of the base 214 until the plunger 216 is used to dispense the product 910.

In use, the base 214 may attach to an opening in the container 900 as illustrated in FIG. 10. A user may pull on the cap 217 of the plunger 216 to move the plunger 216 relative to the base 214. Movement of the plunger 216 creates a vacuum in a cavity within the base 214 which in turn draws product 910 from the container 900 into the cavity in the base 214. For example, a one-way valve in the base between the cavity and the container 900 may control flow of product 910 into the base 214. The base 214 and plunger 216 may be removed from the container 900 as illustrated in FIG. 11 in a charged state. The base 214 and plunger 216 combination may then be moved to a washing machine or other receptacle where the product 910 in the base 214 may be dispensed by pushing on the plunger 216 or cap 217 to force product 910 out of the one-way valve opposite the plunger 216 as illustrated in FIG. 12.

Figure 13:
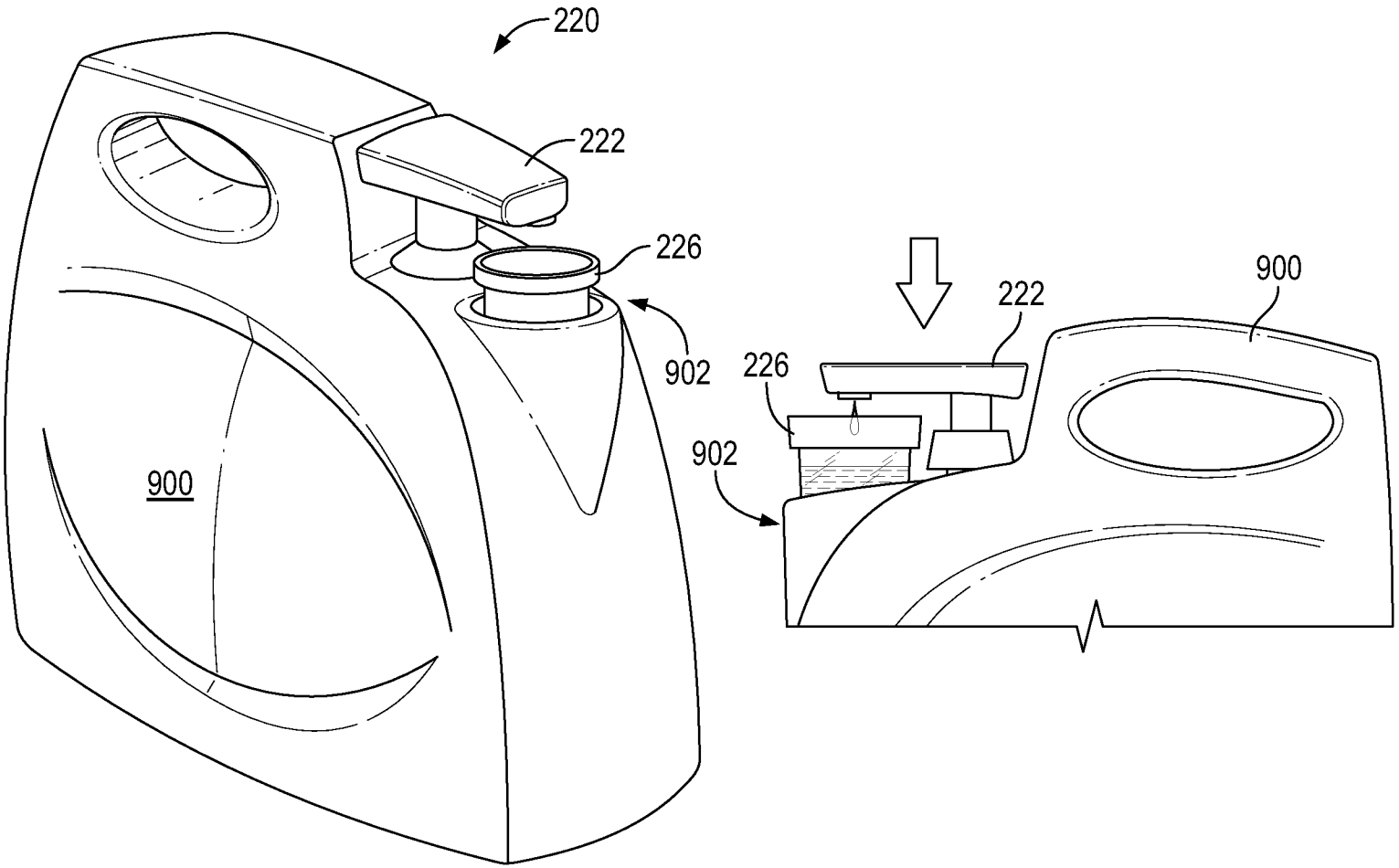
FIG. 13 illustrates a dispensing system according to various embodiments of the invention.

A dispensing system 220 according to some embodiments of the invention is illustrated in FIG. 13. The dispensing system 220 may include a container 900 containing a product 910. The container 900 may include a cup holder 902 into which a cup 226 may positioned or seated. A pump 222 may be attached to the container 900 through an opening therein. The pump 222 may be configured with a pump head such that as the pump 22 is actuated, product 910 is pumped out of the container 900 into a cup 206 seated in the cupholder 902. Once the cup 206 is filled to the desired volume, a user can remove the cup 206, pour the product 910 contained therein out, and return the cup 206 to the cup holder 902 so that any drips or other leakage from the pump 222 may be caught by the cup 206.

Figure 16:
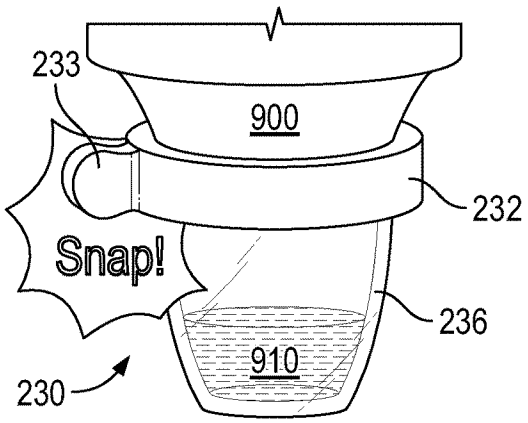
FIG. 16 illustrates a dispensing system according to various embodiments of the invention.
Figure 15:
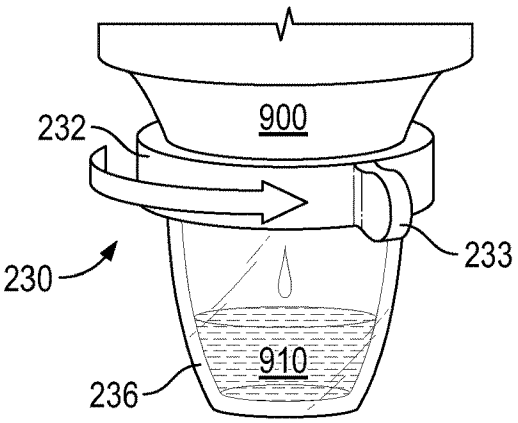
FIG. 15 illustrates a dispensing system according to various embodiments of the invention.
Figure 14:
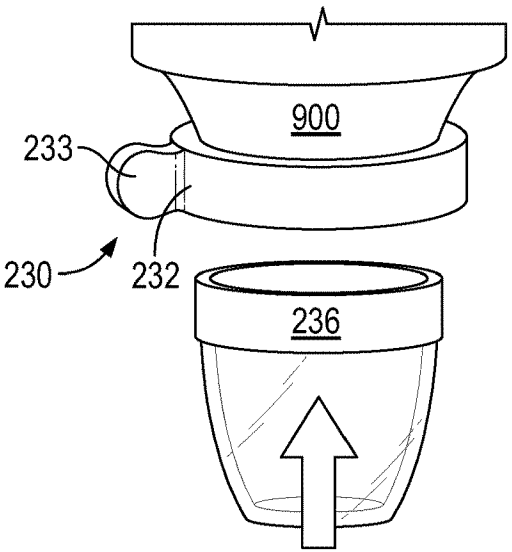
FIG. 14 illustrates a dispensing system according to various embodiments of the invention.
Figure 14:
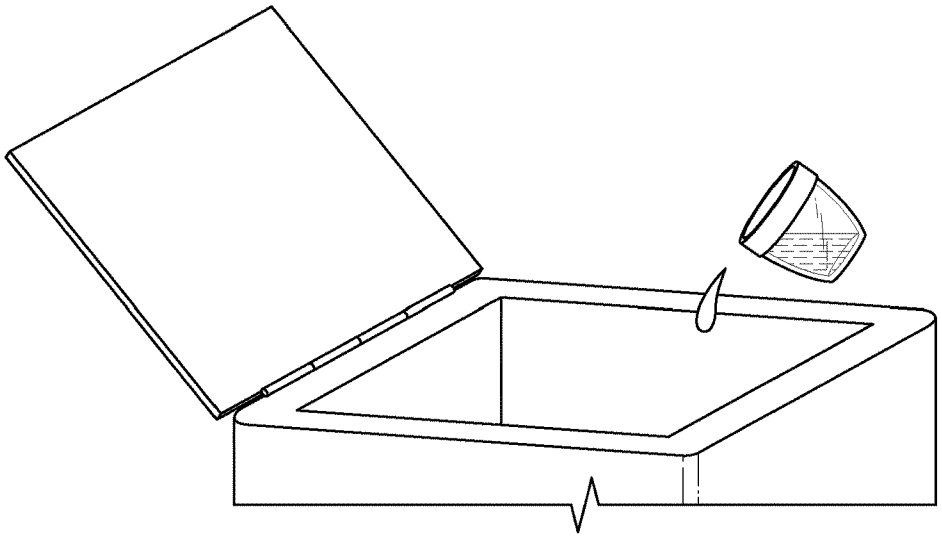

A dispensing system 230 according to various embodiments of the invention is illustrated in FIGS. 14 through 16. The dispensing system 230 may include a dispensing ring 232 attached to a container 900 containing product 910. A cup 236 may be snapped to or otherwise attached to the dispensing ring 232 such that product 910 dispensed from the container 900 flows into the cup 236.

For example, as illustrated in FIG. 14, a cup 236 may be snapped into or otherwise attached to the dispensing ring 232. Once attached, a lever 233 on the dispensing ring 232 may be rotated to dispense product 910 from the container 900 into the cup 236 as illustrated in FIG. 15. Release of the lever 233 allows the dispensing ring 232 to snap back into a non-dispensing position as illustrated in FIG. 16. In some embodiments of the invention, movement of the dispensing ring 232 dispenses a single dose of product 910. In other embodiments, the dispensing ring 232 allows product 910 to flow out of the container 900 as long as the dispensing ring 232 is not in the non-dispensing position. In this way, a user can fill the cup 236 to a desired level and release the lever 233 to allow the dispensing ring 232 to snap back or return to the non-dispensing position.

Figure 17:
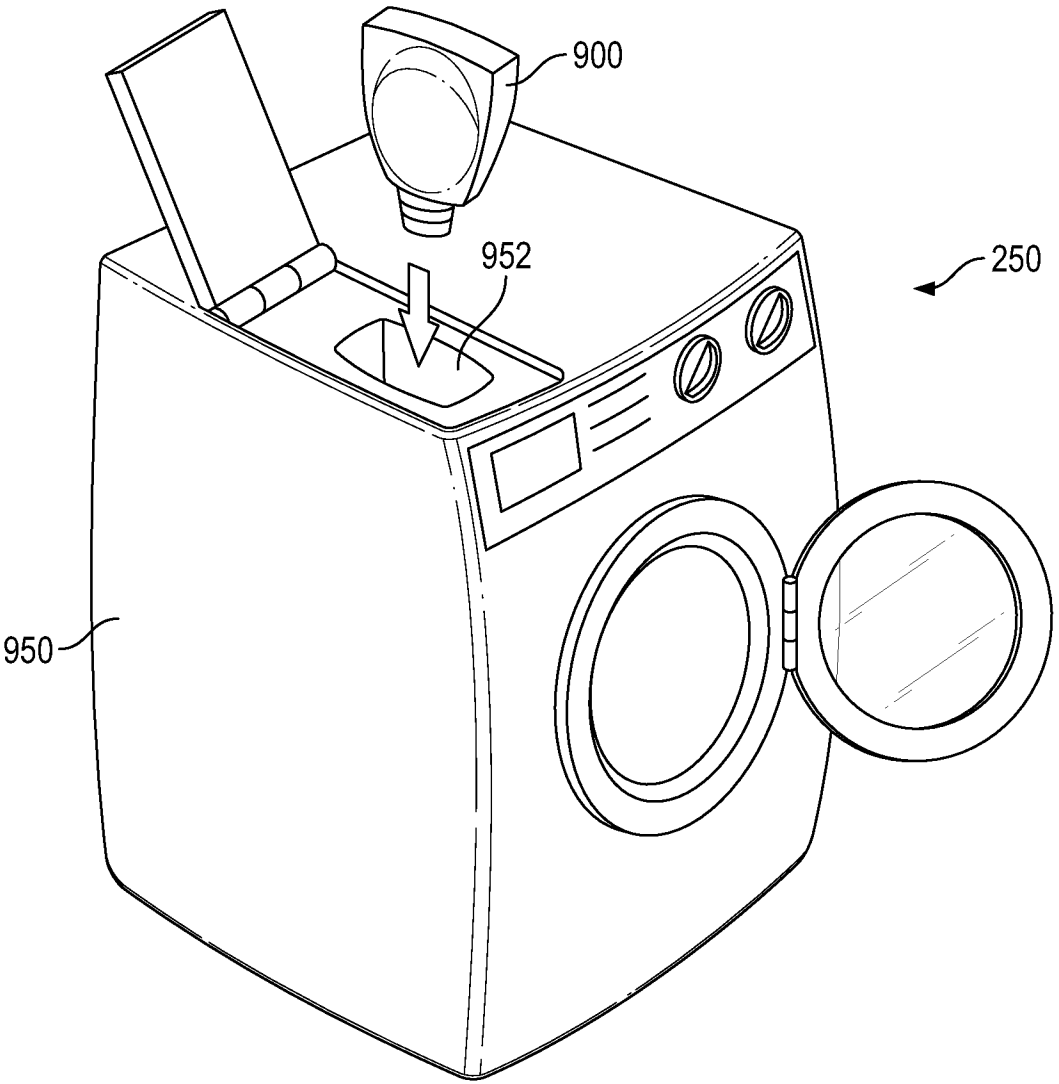
FIG. 17 illustrates a dispensing system according to various embodiments of the invention.

A dispensing system 250 according to some embodiments of the invention includes a washing machine 950 having a product compartment 952 into which a container 900 having a sealed opening may be inserted as illustrated in FIG. 17. Once inserted into the product compartment 952, the sealed opening of the container 900 may be pierced or otherwise unsealed to allow product 910 within the container 900 to dispense into the washing machine 950. The washing machine 950 may be set to dispense a desired amount of product from the container 900 for each load of laundry being cleaned.

Figure 19:
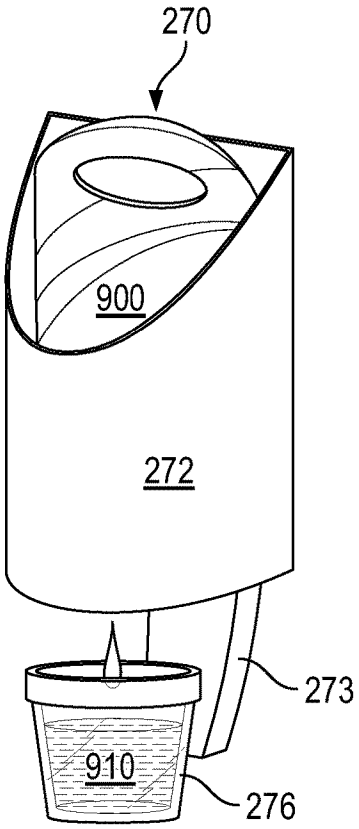
FIG. 19 illustrates a dispensing system according to various embodiments of the invention.
Figure 18:
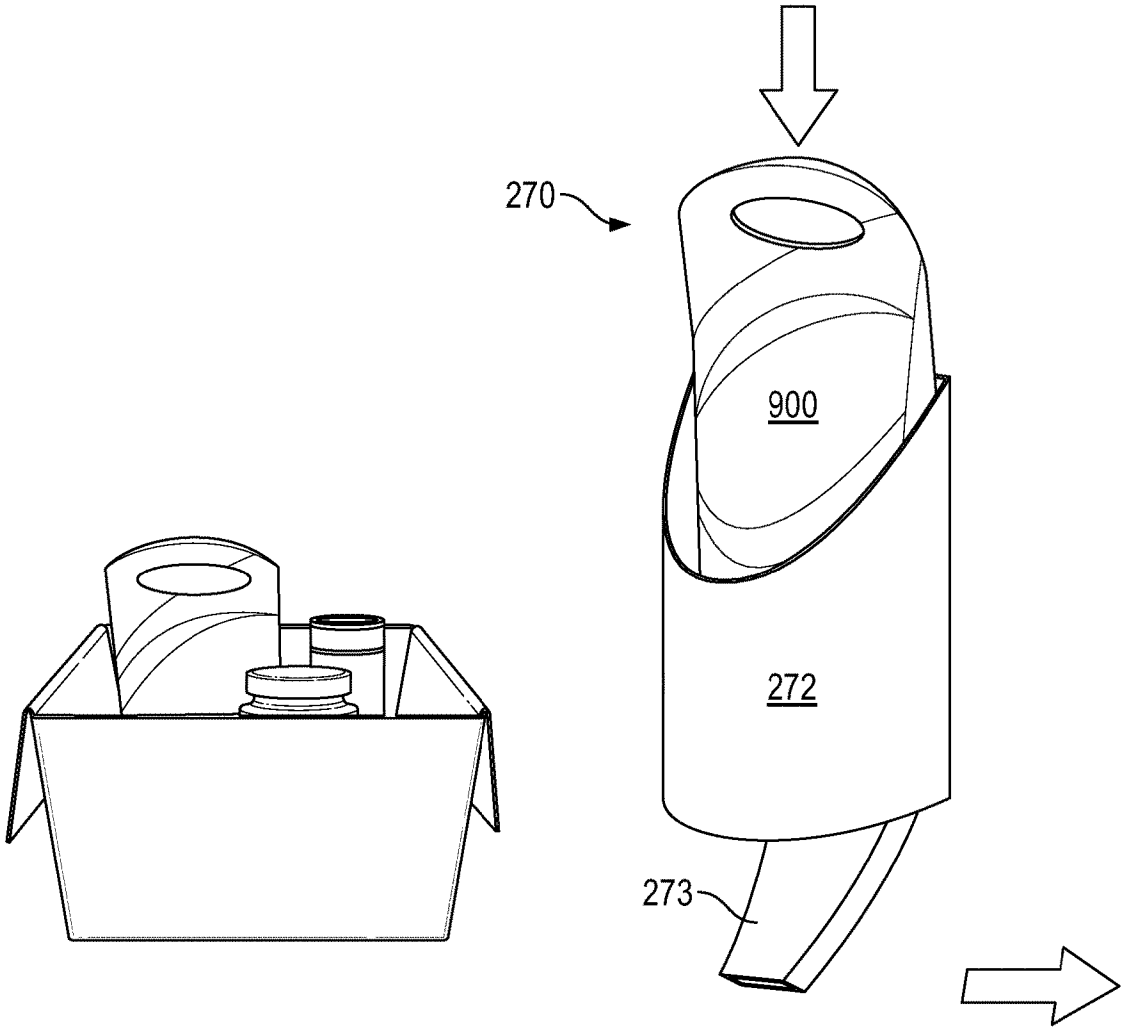
FIG. 18 illustrates a dispensing system according to various embodiments of the invention.

In still other embodiments of the invention, a dispensing system 270 may include a dispenser 272 and a container 900 as illustrated in FIGS. 18 and 19. As illustrated, a dispenser 272 may include a wall-mounted dispenser having an opening into which a container 900 may be inserted. The dispenser 272 may be configured to mate with the container 900 and access the product 910 in the container 900. For example, the container 900 may be pierced by the dispenser 272 to release the product 910 into the dispenser 272. In other embodiments the container 900 may be attached to a plug or needle-like unit to allow flow of product 910 from the container 900 through the dispenser 272. Other known methods for such dispensing features may also be used.

According to embodiments of the invention, a user may buy a container 900 of product 910—for example a refill container 900—and insert it into the dispenser 272 as illustrated in FIG. 18. Insertion of the container 900 into the dispenser 272 may create a flow path for product 910 out of the container and through the dispenser 272. As illustrated in FIG. 19, a user may press a cup 276 up against a lever 273 of the dispenser 272 to open a valve such that product 910 is dispensed or to pump product 910 from the container 900, through the dispenser 272, and into the cup 276. The cup 276 may then be used to dump the product 910 into a washing machine or other desired receptacle.

Figure 20:
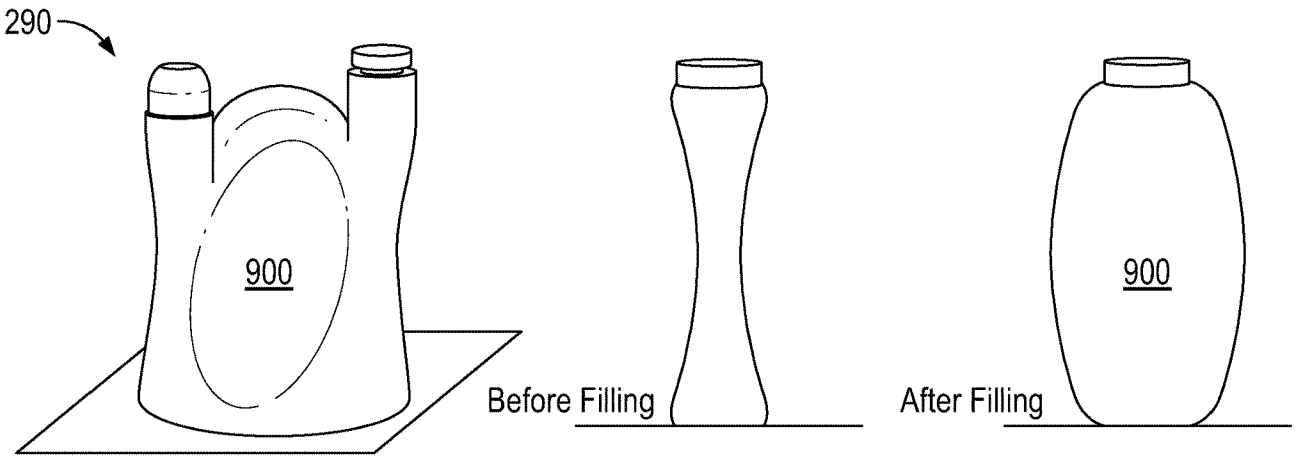
FIG. 20 illustrates a dispensing system according to various embodiments of the invention.
Figure 21:
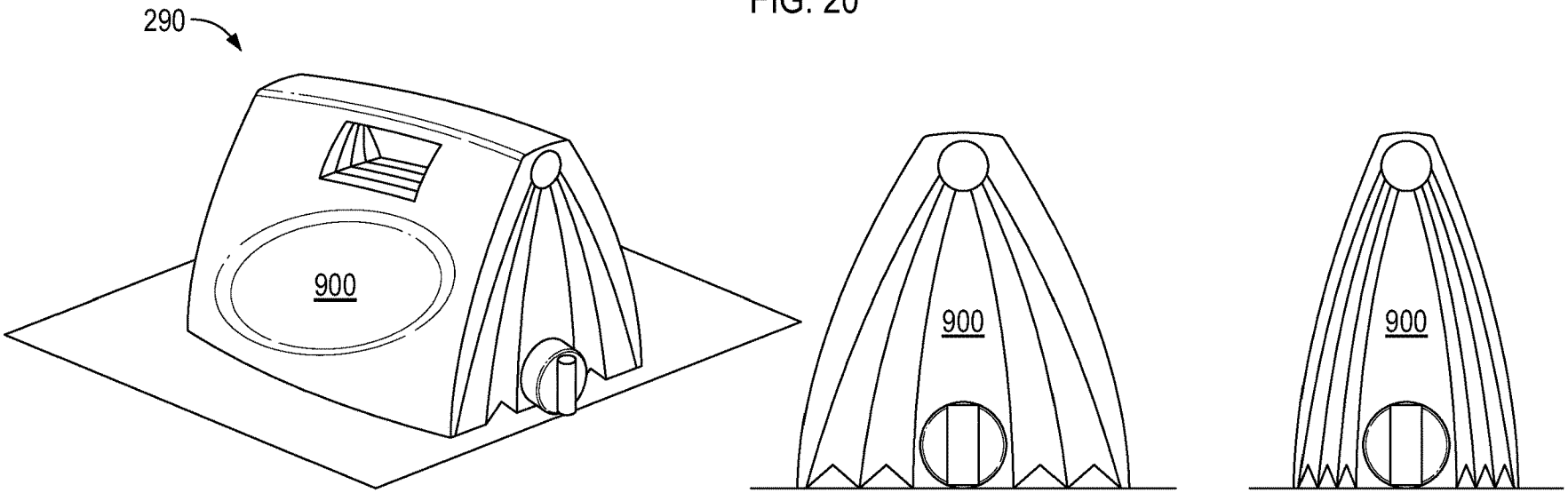
FIG. 21 illustrates a dispensing system according to various embodiments of the invention.

A dispensing system 290 according to still other embodiments of the invention is illustrated in FIGS. 20 and 21. As shown, the dispensing system 290 may include collapsible/expandable containers 900. When manufactured, the containers 900 are in a collapsed state. Filling the containers 900 results in an expansion of the walls of the container 900. The expanded walls, however, apply a force against the product inside the containers 900 as the walls try to return to the original non-filled state. The forces applied by the walls facilitate rapid flow of product 910 out of the container 900 when a valve or dispensing system such as those described herein is actuated to allow product out of the container 900. Continual collapsing of the container 900 results in the fluid within the container being pushed out of the container.

Figure 22:
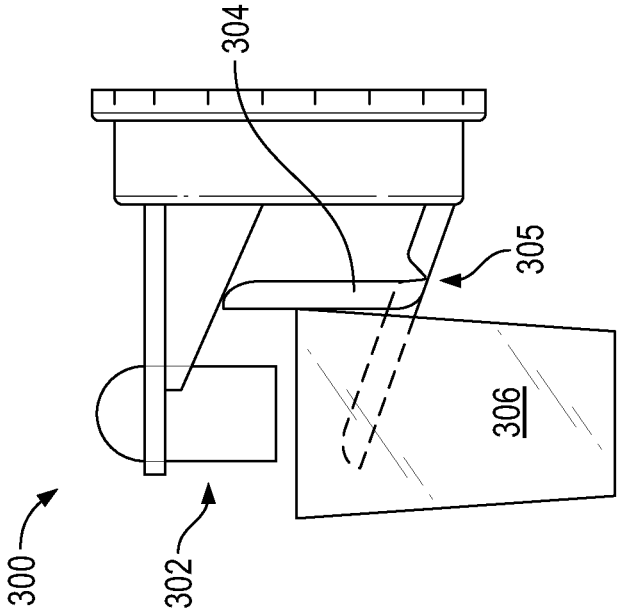
FIG. 22 illustrates a dispensing system according to various embodiments of the invention.

A dispensing system 300 according to still other embodiments of the invention is illustrated in FIG. 22. As illustrated, the dispensing system 300 may include a dispenser 302 and a cup 306. A drip collector 304 extending off of the dispenser 302 below an output path may include a living hinge 305 such that a portion of the drip collector 304 may be moved vertically so that it is outside of the flow path when a user moves a cup 306 below the dispenser 302. Once a cup 306 is moved away from the dispenser 302, the living hinge allows that portion of the drip collector 304 that moved to return to the original position to collect any drips that may come out of the dispenser 302 when not in use.

Figure 23:
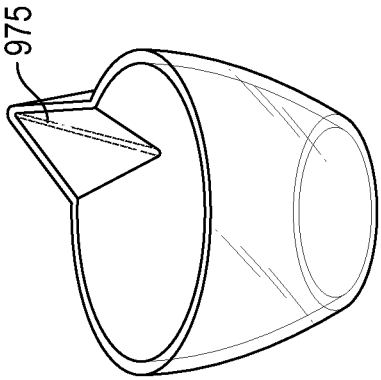
FIG. 23 illustrates a cup for use with a dispensing system according to various embodiments of the invention.

According to various embodiments of the invention, a cup may include a pour feature 975 as illustrated in FIG. 23 to help reduce spillage of product 910 from a cup during use. The pour feature 975 may also be configured to assist with pouring a product 910 into a precise area or location as desired by the user.

Figure 24:
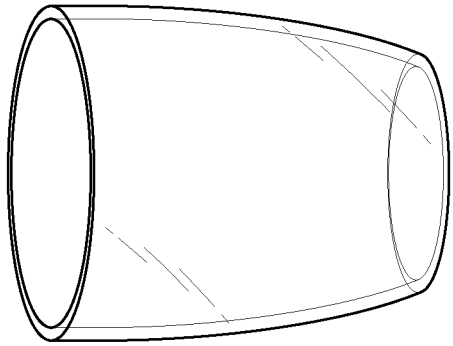
FIG. 24 illustrates a cup for use with a dispensing system according to various embodiments of the invention.

In other embodiments of the invention, a cup may include a hydrophobic texture molded into the cup as illustrated in FIG. 24. The presence of the hydrophobic texturing may improve movement of a product 910 out of the cup such that residual product 910 is not built-up or contained in the cup after use or so that all of the product 910 may be easily poured out of the cup.

A dispensing system 310 according to other embodiments of the invention is illustrated in FIG. 25.

A dispensing system 320 according to other embodiments of the invention is illustrated in FIG. 26.

A dispensing system 330 according to other embodiments of the invention is illustrated in FIG. 27. As illustrated, the dispensing system 330 may include a soap receptacle 332, a water receptacle 334 and a product dispenser 336 or cup. Soap may be placed in the soap receptacle 332 and water in the water receptacle 334. A user may then insert the product dispenser 336 into an opening in the dispensing system 330 into which a mixture of soap and water is dispensed. Based on the load size or the desired amount of soap, a user can select the desired product strength and the dispensing system 330 mixes a fixed amount of soap with a fixed amount of water into the product dispenser 336. The product dispenser 336 may then be inserted for use in a washing machine or the resulting product may be poured into a washing machine or other receptacle as desired.

Figure 31:
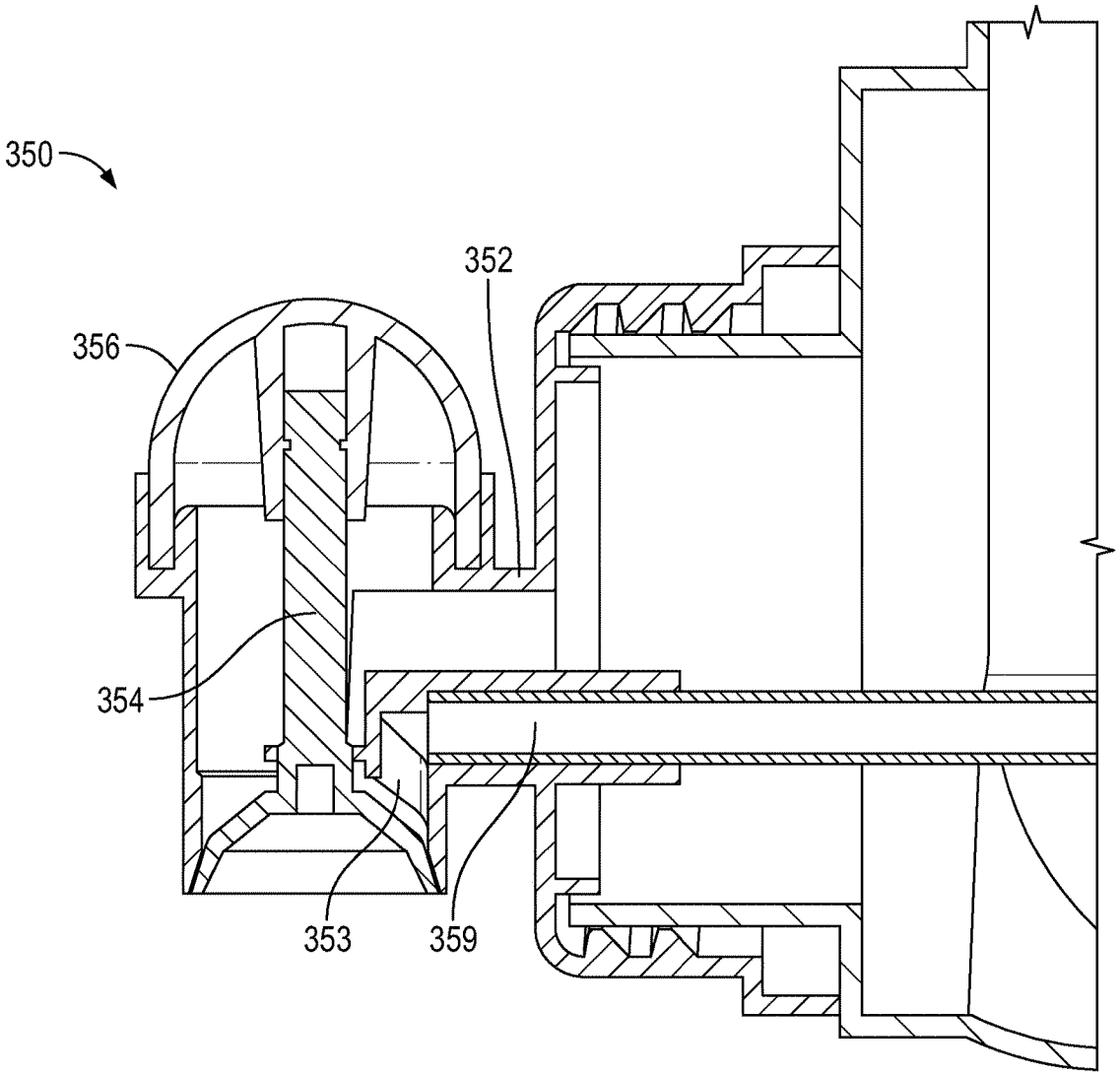
FIG. 31 illustrates a dispensing system according to various embodiments of the invention.

A dispensing system 350 according to still other embodiments of the invention is illustrated in FIG. 31. As shown, a traditional press-tap system having a body 352, a valve 354 and a flexible dome 356 may be improved by the inclusion of a vent path 353 through the body 352 connected to a clip-tube 359. The improved press-tap system allows air to vent into the container 900 without the need for a separate vent cap and second opening in the container as required with traditional press-tap systems. In some embodiments of the invention, the clip-tube 359 may be a blown-in-dip-tube, having been formed integrally with the container 900 such that a clip-tube is not required; instead, the vent path may mate with the blown-in-clip-tube of the container 900.

Figure 32:
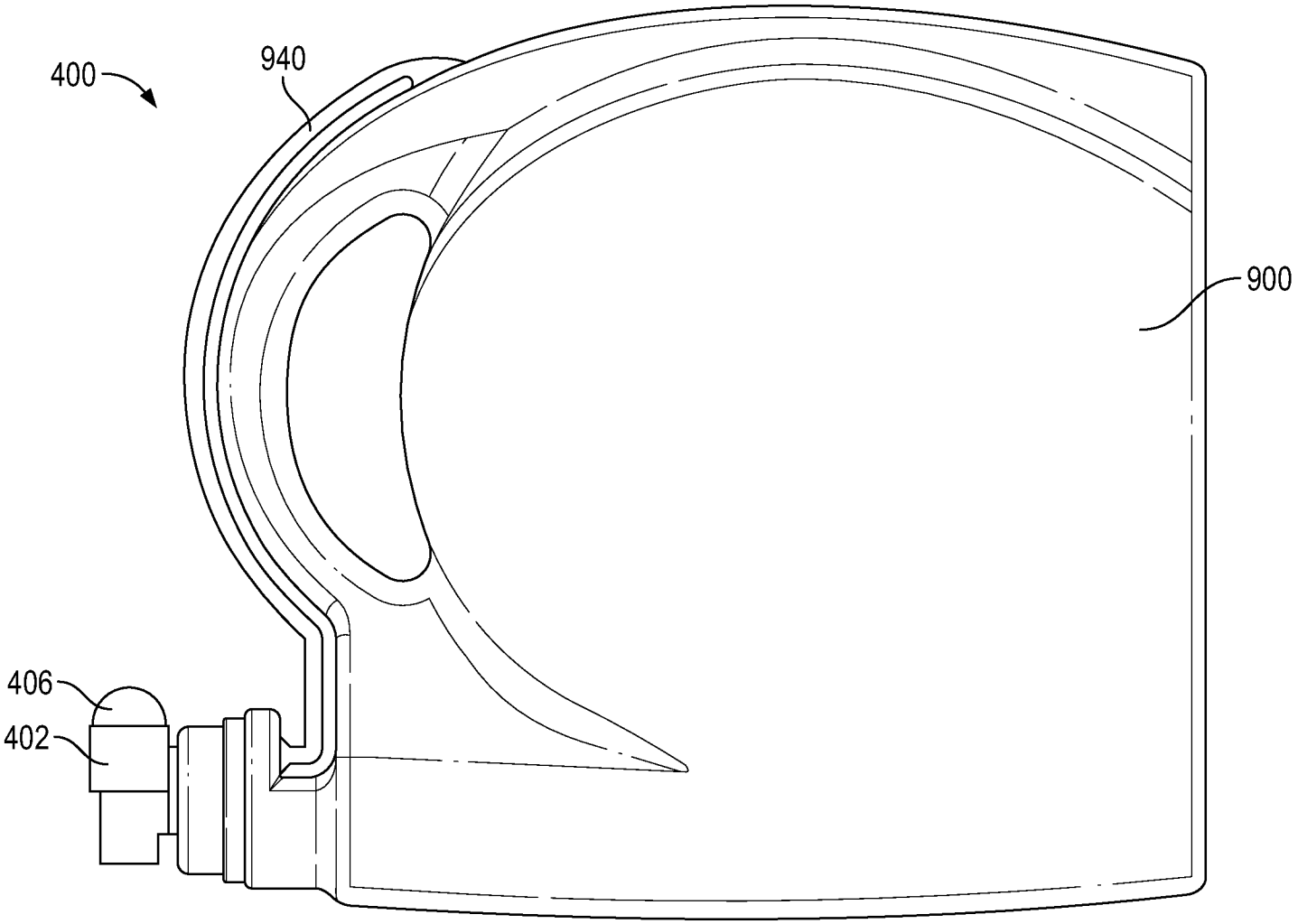
FIG. 32 illustrates a dispensing system according to various embodiments of the invention.
Figure 33:
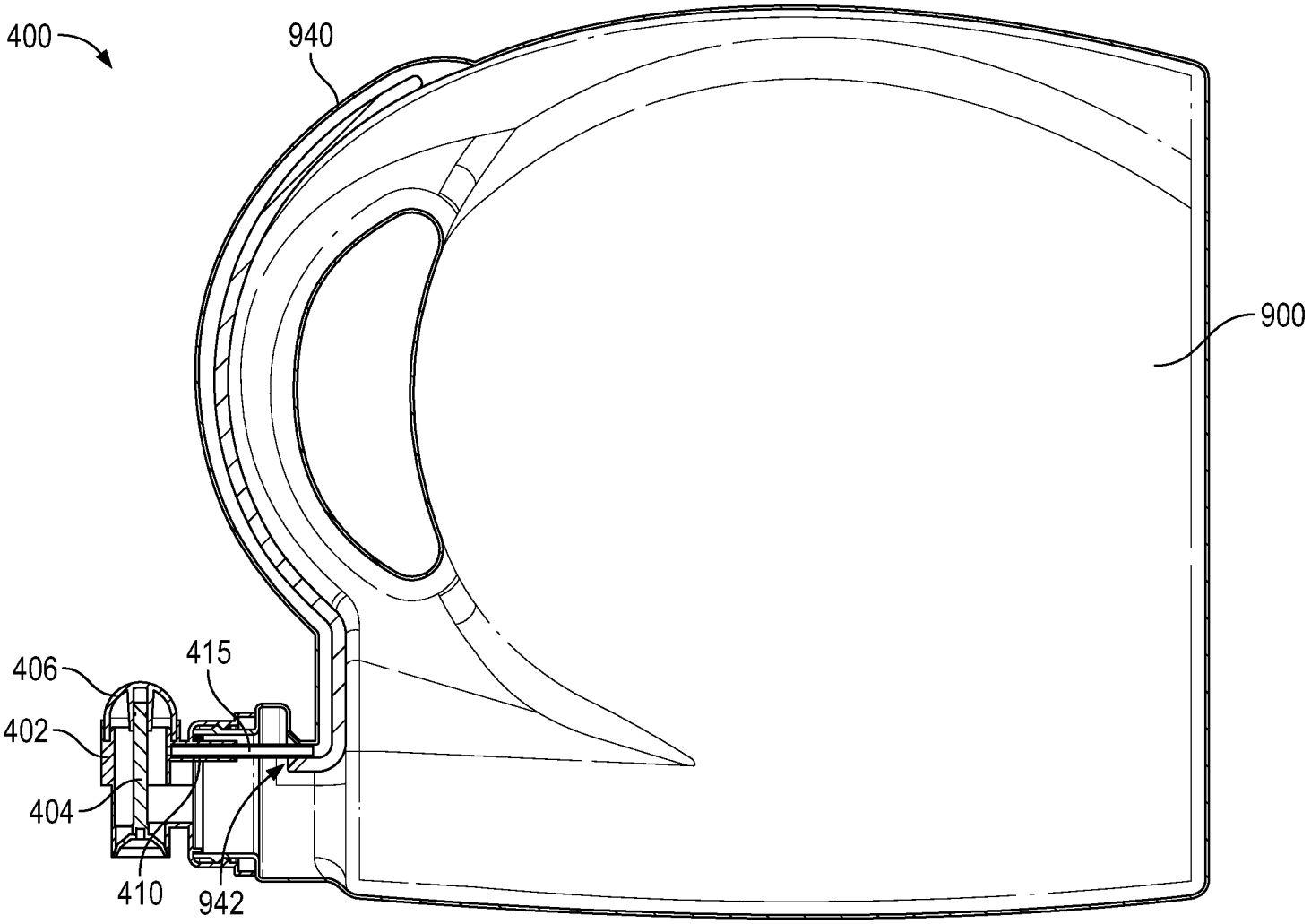
FIG. 33 illustrates a cross-sectional view of a dispensing system according to various embodiments of the invention.
Figure 34:
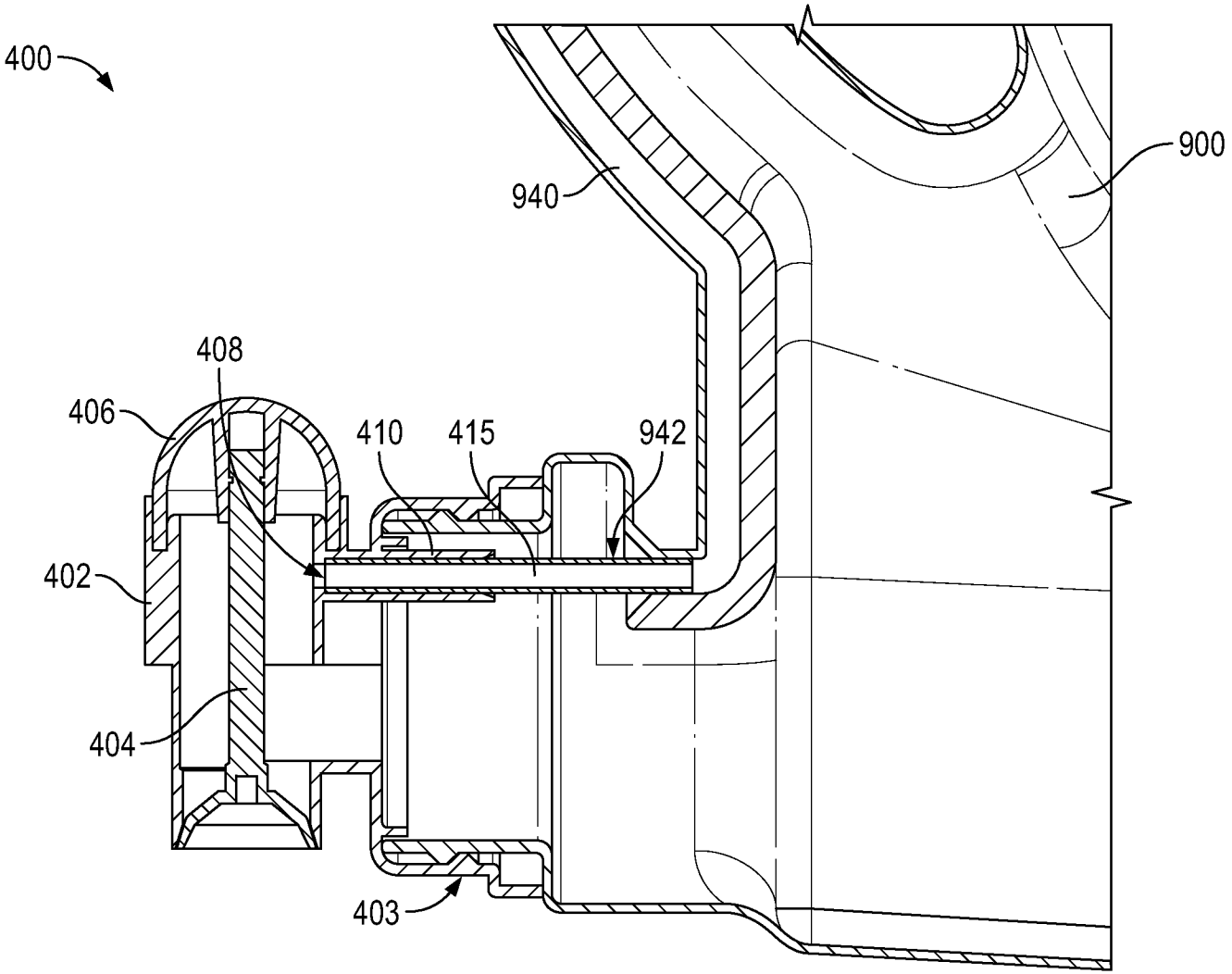
FIG. 34 illustrates a cross-sectional view of a dispensing system according to various embodiments of the invention.

A dispensing system 400 according to other embodiments of the invention is illustrated in FIGS. 32 through 34. As illustrated in FIG. 32, the dispensing system 400 may include components of a traditional press-tap dispensing system, including a container 900, a body 402, and a flexible dome 406. The flexible dome 406 may be connected to a valve 404 housed in the body 402 such that when a user presses on the flexible dome 406, the valve 404 opens to allow product 910 to drain from the container 900 by gravity. The dispensing system 400 illustrated, however, includes additional features which improve the operation of traditional press-tap dispensing systems. In particular, according to certain embodiments of the invention, a container 900 may include a blown-in vent path 940. The vent path 940 may include a tube or path integrally formed with the container 900 to allow air to vent into the container 900 when the flexible dome 406 is pressed and the valve 404 is opened. The vent path 940 may have one end positioned adjacent an opening in the container 900 to which a dispenser is attached. A second end of the vent path 940 may extend into a portion of the container 900 that is near the top of the container 900 when the container 900 is positioned for dispensing. For example, as illustrated in FIG. 32, the vent path 940 may extend from an area adjacent the opening to which the body 402 is attached to the "top" of the container 900 when it is resting in the illustrated position.

As illustrated in the cross-sectional views of FIGS. 33 and 34, the improved dispensing system 400 of various embodiments of the invention also includes a vent hole 408 in a wall of the body 402. The vent hole 408 leads into an interior volume of a tube retainer 410 molded with the body 402. The container 900 may have a vent path 940 having a landing 942 at a terminal end thereof adjacent to an opening in the container 900 to which the body 402 is attached. The landing 942 may be conical in shape or may be configured to accept a tube 415, tube retainer 410, or other feature to provide a flow path between the vent hole 408 and the vent path 940. For example, as illustrated in FIG. 34, one end of a tube 415 may be inserted and secured in the tube retainer 410. The other end of the tube 415 may be inserted in the opening of the vent path 940 adjacent the landing 942. The landing 942 may facilitate placement of the tube 415 into the vent path 940 upon assembly. The end of the tube 415 inserted into the vent path 940 may seal against the walls of the vent path 940 to form a fluid-tight seal.

In some embodiments of the invention, a tube 415 may not be needed. Rather, the tube retainer 410 itself may have a sufficient length such that it may have one end capable of being inserted into the vent path 940 and forming a seal therewith, forming a path from the vent hole 408 to the vent path 940.

While a tube 415 or tube retainer 410 may seal against the walls of the vent path 940 in sufficient manner to provide the necessary seal, additional features may be added to the end of a tube 415 or tube retainer 410 to assist in sealing the point of contact with the vent path 940. For example, in some embodiments of the invention an o-ring may be placed around an end of a tube 415 or tube retainer 410 to facilitate a fluid tight seal. In other embodiments, the end of the tube 415 or tube retainer 410 may be bi-injected with a material that can provide a better sealing contact with the vent path 940. In still other embodiments of the invention, the end of the tube 415 or tube retainer 410 may include ridges that facilitate a better seal against the interior walls of the vent path 940.

An improved dispensing system 400 may also include a body 402 having a snap-fit or bayonet connection 403 capable of securing the body 402 to the container 900 as illustrated. A snap-fit or bayonet connection 403 may allow the body 402 to be attached to the container 900 while aligning the tube 415 or tube retainer 410 with the landing 942 of the vent path 940. This may help to facilitate insertion of the tube 415 or tube retainer 410 into the vent path 940 during assembly of a body 402 with a container 900.

According to other embodiments of the invention, a dispensing system may include the combination of the two-piece dispensing system 100 of the present invention with a vent hole 408, tube retainer 410, tube 415, and container 900 having a vent path 940. The two-piece dispensing system 100 may be modified to include a vent hole 408 and a tube retainer 410. In some embodiments, the tube retainer 410 may be inserted into a vent path 940 of a container 900. In other embodiments, a tube 415, inserted into the tube retainer 410 at one end and the vent path 940 at the other end, may provide a vent path from an interior of the body 102 of the two-piece dispensing system 100 into the vent path 940.

Figure 35:
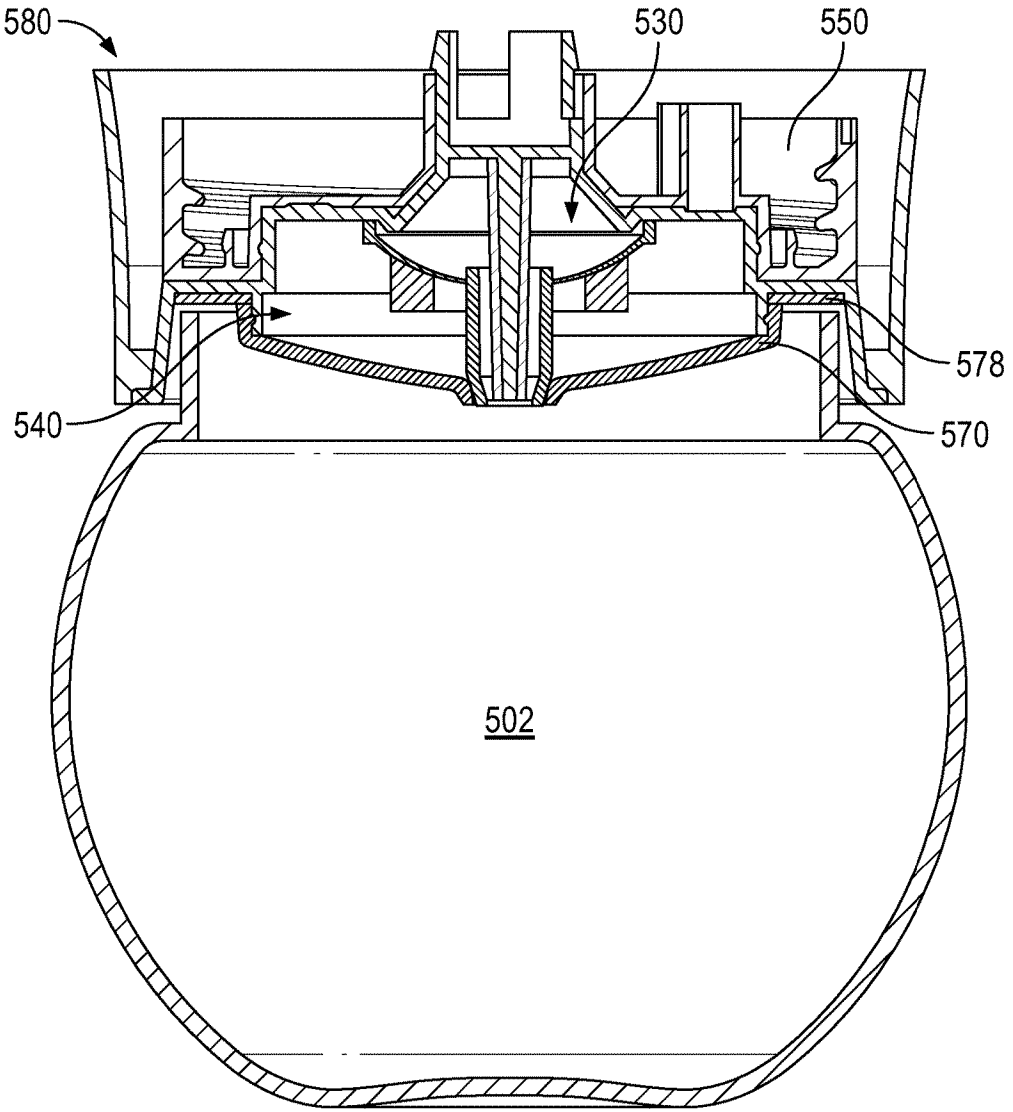
FIG. 35 illustrates a cross-sectional view of a dispensing system according to various embodiments of the invention.
Figure 36:
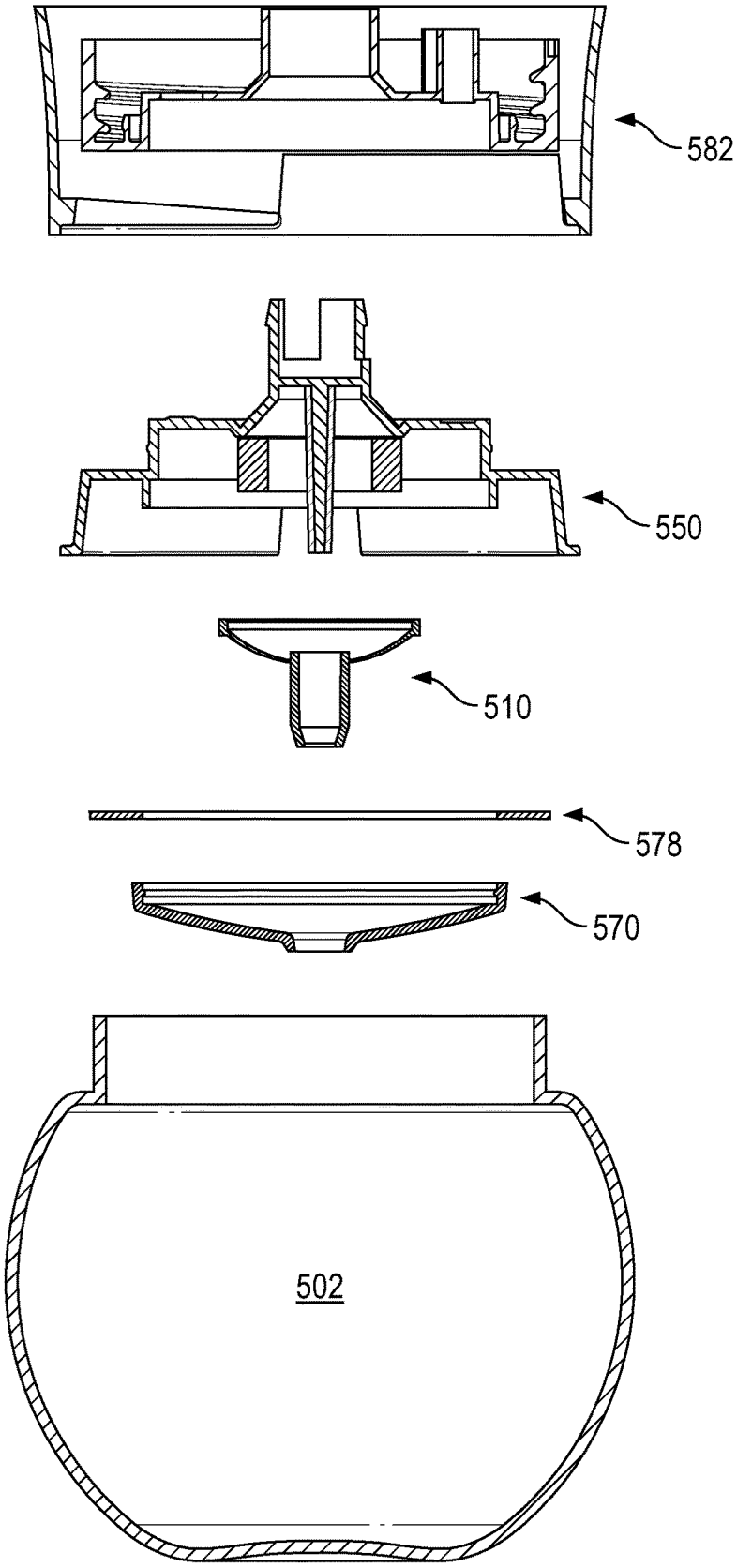
FIG. 36 illustrates an exploded cross-sectional view of a dispensing system according to various embodiments of the invention.

According to still other embodiments of the invention, a dispensing system 580 may include a closure body 582, a chamber body 550, a gasket 578, a chamber cap 570, and a valve 510 as illustrated in FIGS. 35 and 36. A dispensing ball 502 may attach to the dispensing system 580. A dispensing system 580 may be attached to a container 900 that is filled with product 910 or is to be filled with a product 910. For example, a dispensing system 580 according to various embodiments of the invention may be attached to a container 900 filled with laundry detergent such that a user may dispense laundry detergent from the container utilizing the dispensing system 580.

As illustrated in FIG. 35, a dispensing system 580 according to various embodiments of the invention may include a closure body 582 configured to attach to a container 900 and more particularly about, over, or around an opening in a container 900. A closure body 582 may be shaped such that it fits with the container 900 in an aesthetically pleasing manner, in a functional manner, or both. In some embodiments of the invention, the exterior shape and appearance of the closure body 582 may be configured to fit with, blend in, or act as part of the exterior aesthetic design of a container 900 to which the closure body 582 is attached.

As illustrated in FIG. 35, in an assembled state a dispensing system 580 according to various embodiments of the invention may include a chamber body 550 attached to a closure body 582. The chamber body 550 may be attached to the closure body 582 such that the chamber body 550 may be rotated relative to the closure body 582. A gasket 578 may seat against a portion of the chamber body 550 and a chamber cap 570 may attach to the chamber body 550. For example, as illustrated in FIG. 35, the chamber cap 570 may snap-fit with the chamber body 550. The chamber cap 570 may hold or retain a gasket 578 between the chamber cap 570 and the chamber body 550. The fitment of the chamber cap 570 with the chamber body 550 defines a product chamber 540 in a volume or space therein. A valve 510 is seated within the product chamber 540. An outlet end 512 of the valve 510 may seal against an opening or product outlet 572 in the chamber cap 570. A vent seal 516 at the end of the valve 510 opposite the outlet end 512 may seal against a portion of an interior of the chamber body 550. The valve 510 may include an opening 518 through the valve 510 from the outlet end 512 towards the vent seal 516. The valve 510 may also include a spring 514 configured to move, or to allow movement of, the outlet end 512 of the valve 510 and the vent seal 516 of the valve 510. An air chamber 530 is formed between an interior portion of the valve 510 and the chamber body 550.

FIG. 36 illustrates an exploded view of a dispensing system 580 according to various embodiments of the invention, including a closure body 582 to which a chamber body 550 may be attached. A valve 510 may be positioned between the chamber body 550 and a chamber cap 570 that is attached to the chamber body 550. A gasket 578 may also be positioned between the chamber body 550 and the chamber cap 570. A dispensing ball 502 may be fitted to the chamber body 550 and filled using the dispensing system 580.

According to various embodiments of the invention, a dispensing system 580 as illustrated in FIG. 36 may be assembled by attaching the chamber body 550 to the closure body 582. A valve 510 may be dropped onto the chamber body 550 along with a gasket 578. A chamber cap 570 may be fitted to the chamber body 550, thereby fixing the valve 510 within the product chamber 540 formed between the chamber body 550 and chamber cap 570. The assembled system is illustrated in FIG. 35 with a dispensing ball 502 also attached thereto.

In various embodiments of the invention, a dispensing ball 502 is removable from the dispensing system 580. In some embodiments, a dispensing ball 502 may include one or more latches, projections, or other features extending away from the mouth of the dispensing ball 502. For example, a dispensing ball 502 may include two or more projections extending outward or inward from an opening or mouth in the dispensing ball 502. The projections may be configured to mate with a portion of the chamber body 550 to facilitate movement of the chamber body 550 relative to the closure body 582. For example, in some embodiments of the invention, a dispensing ball 502 may include a mouth configured to seal with a portion of the dispensing system 580 when the dispensing ball 502 is positioned under the dispensing system 580 as illustrated in FIG. 35. The dispensing ball 502 may be pushed up against the gasket 578 and then rotated whereby such rotation causes movement of the chamber body 550 relative to the closure body 582. Projections extending off of the dispensing ball 502 may assist with moving the chamber body 550. In some embodiments of the invention, the closure body 582 may also include visual cues or projection paths that will only allow a dispensing ball 502 to be accepted by or put in contact with a chamber body 550 in a certain position. Thus, a user may have to rotate the dispensing ball 502 into a position in which the closure body 582 will allow projections extending from the dispensing ball 502 to mate with the chamber body 550 for rotation thereof.

Figure 37:
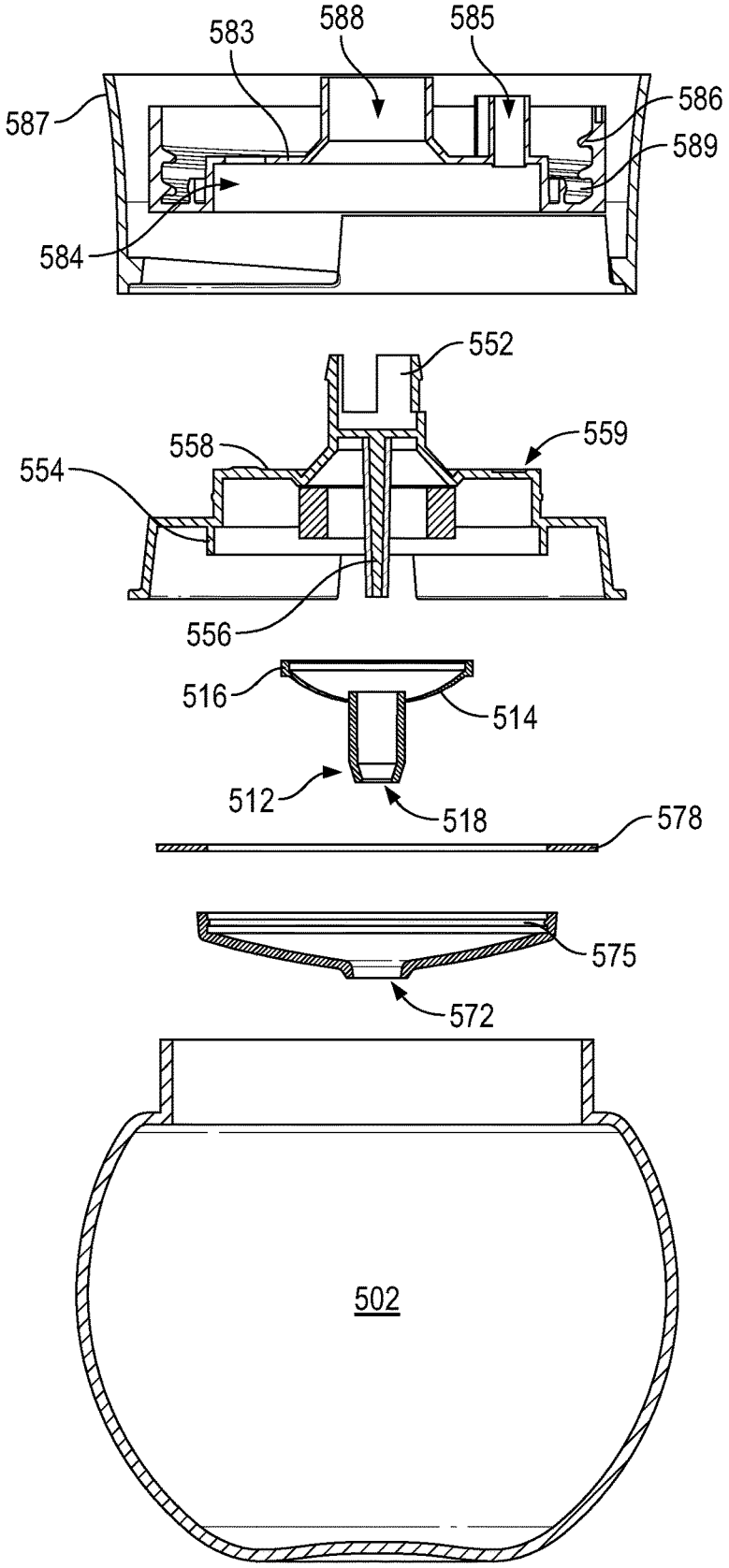
FIG. 37 illustrates an exploded cross-sectional view of a dispensing system according to various embodiments of the invention.

In particular embodiments of the invention, a closure body 582 may include a closure deck 583. A closure attachment 586 may extend outward, upward, downward, or away from the closure deck 583. The closure attachment 586 may include features configured to attach the closure body 582 to a container 900. For example, as illustrated in FIG. 37, the closure attachment 586 may include threads to allow the closure body 582 to be screwed onto a container 900 having a threaded opening. In other embodiments of the invention, a closure attachment 586 may include bayonet-style attachment features, snap-style attachment features, rachet features, or other features to allow the closure body 582 to be attached to a container 900 either permanently or temporarily.

A plug seal 589 may also extend off of the closure deck 583 to facilitate a tight seal with a container 900. For instance, as illustrated in FIG. 37, a plug seal 589 is positioned interior of the closure attachment 586 such that when attached to a container 900, the plug seal 589 is on an interior of the container 900 opening while the closure attachment 586 is on an exterior of the container 900 opening.

A closure deck 583 may also include at least one inlet 584 opening passing through the closure deck 583. At least one vent 585 opening passing through the closure deck 583 may also be present in various embodiments of the invention. An additional opening 588 or openings may also be configured in the closure deck 583 as illustrated in FIG. 37.

A closure body 582 may also include a skirt 587. A skirt 587 may be integrally formed with the closure body 582 or may be a separate piece that snaps to or otherwise connects with the closure body 582.

As illustrated in FIG. 37, a chamber body 550 may include one or more body connections 552, a cap seal portion 554, a valve post 556, one or a product openings 558 and a vent opening 559.

The at least one body connection 552 may connect to the body closure 582. For example, a body connection 552 may include compression latches that may be forced into an opening 588 in the body closure 582 such that when the end of the body connection 552 extend past the opening 588 they spring out, holding the chamber body 550 in contact with the closure body 582. In various embodiments of the invention, the body connection 552 is configured to allow the chamber body 550 to rotate relative to the closure body 582 once attached.

A valve 510 may be seated over a valve post 556 of the chamber body 550 such that the valve post 556 extends through an opening in the valve 510. A chamber cap 570 may snap-fit, screw-on, or otherwise connect to the cap seal portion 554 of the chamber body 550.

The chamber body 550 may include a vent opening 559 and a product opening that are aligned with the vent 585 and inlet 584 in a dispensing mode and not aligned in a non-dispensing mode. For instance, in a non-dispensing mode the product opening 558 in the chamber body 550 is adjacent to a portion of the closure deck 583 such that fluid or product cannot pass therethrough. Similarly, in the non-dispensing position or mode, the vent opening 559 may be aligned with or in contact with a portion of the closure deck 583 such that air cannot flow through the vent 585. Upon rotation of the chamber body 550 into a dispensing position or mode, the product opening 558 is aligned with the inlet 584 in the closure body 582 such that product in a container 900 may flow through the inlet 584, through the product opening 558, and into the product chamber 540. Similarly, upon rotation of the chamber body 550 into a dispensing position or mode, the vent opening 559 is aligned with the vent 585 in the closure body 582 such that air may pass from within the product chamber 540, through the vent opening 559, through the vent 585, and into a container 900 attached to the dispensing system 580.

According to various embodiments of the invention, rotation of the chamber body 550 may be accomplished by attaching a dispensing ball 502 to the dispensing system 580 and rotating the dispensing ball 502. In other embodiments, a lever or other device could be used, attached to, or molded with the chamber body 550 to allow movement of the chamber body 550 relative to the closure body 582 in order to align the product opening 558 with the inlet 584 and the vent opening 559 with the vent 585.

A valve 510 according to various embodiments of the invention may include a valve body having an outlet end 512 at one end and a vent seal 516 at an opposite end. The vent seal 516 may be part of, attached to, or adjacent to a spring 514. An opening 518 through the valve 510 may pass through the outlet end 512 and may provide access to an interior surface of the valve 510 and the spring 514.

In some embodiments of the invention, a valve 510 may be made of an elastomeric material such that the spring 514 is part of the entire valve. Movement of the spring 514—or forces applied to the spring 514—may allow movement of the outlet end 512 and the vent seal 516.

A gasket 578 may be positioned on an exterior portion of the chamber body 550 and held in place by the chamber cap 570. A gasket 578 may be made of any material required to help seal an opening of a dispensing ball 502 with the dispensing device 580 in use.

A chamber cap 570 according to various embodiments of the invention may include a product outlet 572 and a seal ring 575. The seal ring 575 may be configured to attach to a chamber body 550. For example, the seal ring 575 may screw-on, snap-to, or otherwise connect with the chamber body 550.

The product outlet 572 of the chamber cap 570 is in contact with the outlet end 512 of a valve 510 when assembled. The contact between the outlet end 512 of the valve 510 and the product outlet 572 forms a fluid tight seal, preventing product in the product chamber 540 from being dispensed through the product outlet 572.

According to various embodiments of the invention, a dispensing system 580 may be attached to a container 900 filled with a product 910 or to a container 900 which is then filled with a product 910. Once attached, the dispensing system 580 may be used to regulate flow of the product 910 from the container 900.

In some embodiments of the invention, a dispensing system 580 will be attached to a dispensing ball 502 when attached to a container 900. In other embodiments, a dispensing ball 502 may be separate from and distributed with the container 900 or separately from the container 900.

In order to operate a dispensing system 580 according to various embodiments of the invention, a user may attach a dispensing ball 502 to the dispensing system 580. The opening of a dispensing ball 502 may be inserted towards the dispensing system 580 such that the opening engages a chamber body 550 or a gasket 578 between the chamber body 550 and the dispensing ball 502. Rotation of the dispensing ball 502 rotates the chamber body 550. Sufficient rotation will align—and unlock—the dispensing system 580 such that the product opening 5508 of the chamber body 550 is aligned with the inlet 584 of the closure body 582. In addition, in the unlocked position, the vent opening 5509 of the chamber body 550 is aligned with the vent 585 of the closure body 582. A user may then squeeze the dispensing ball 502—which may be made of an elastomeric material—forcing air contained in the dispensing ball 502 through the opening 518 in the valve 510 and into the air chamber 530. The pressure caused by the user's squeezing of the dispensing ball 502 unseats the vent seal 516 of the valve from the chamber body 550 wall, allowing air to flow into the product chamber 540 and out through the vent opening 5509 and vent 585 into the container 900. Upon release of the pressure—or a balancing thereof in the air chamber 530—the vent seal 516 of the valve 510 seals back against the wall of the chamber body 550, forming a seal therewith. At the same time, back-pressure or a vacuum formed in the dispensing ball 502 applies force to the spring 514, causing the spring 514 to lift the outlet end 512 of the valve 510 away from the product outlet 572 in the chamber cap 570. This opens a path for fluid or product 910 in the product chamber 540 to pour into the dispensing ball 502. In addition, because the product opening 5508 and inlet 584 are aligned, product 910 from within the container 900 may flow into the product chamber 540 and into the dispensing ball 502.

Once the dispensing ball 502 has returned to its normal shape, the outlet end 512 of the valve 510 reseats against the product outlet 572, forming a seal therewith and preventing further fluid flow into the dispensing ball 502.

If additional product is desired in the dispensing ball 502, the dispensing ball 502 may be squeezed again to force air through the vent system, creating a vacuum which allows the valve 510 to unseat and allow additional product into the dispensing ball 502. Once the desired amount is reached in the dispensing ball 502, a user may rotate the dispensing ball 502, sealing off the product opening 5508 and vent opening 5509 so that the dispensing ball 502 may be removed from the dispensing system 580 without leaking. The product 910 in the dispensing ball 502 may then be used as desired.

During the priming or squeezing of the dispensing ball 502, air pressure may prevent product 910 from entering the air chamber 530. However, if some product 910 does enter the air chamber 530, that product 910 may drip out of the opening 518 in the valve 510 and into the dispensing ball 502. Thus, to further avoid dripping, a user may wish to keep the dispensing ball 502 attached to the dispensing system 580 when not in use.

While various embodiments of the invention are described herein, it is understood that the particular embodiments defined by the appended claims are not to be limited by particular details set forth in the description, as many apparent variations thereof are contemplated. Furthermore, while various embodiments are described with respect to laundry applications, it is understood that such dispensers may be used for or with other applications and that the dispensers are not limited to laundry solutions. Rather, embodiments of the invention are limited only by the appended claims, which include within their scope all equivalent devices or methods which operate according to the principles of the embodiments of the invention described and which are not limited by an intended use.

What is claimed is:

1. A laundry product, comprising:
a container;
a laundry product in the container;
a dispensing system attached to the container; and
a dispensing ball removably attached to the dispensing system, said dispensing ball having a flexible outer wall and an open interior for receiving a dose of said laundry product from the container,
wherein the dispensing system comprises
a closure body having a closure deck and a closure attachment attached to the container, the closure deck having a product inlet and a vent,
a chamber body rotatably attached to the closure body, the chamber body having a product opening and a vent opening which are rotatably aligned with the product inlet and the vent of the closure body in a dispensing mode and not aligned in a non-dispensing mode,
a chamber cap attached to the chamber body, the chamber cap having an outlet, and
an elastomeric valve positioned between the chamber body and the chamber cap outlet creating an air chamber between an inside of the elastomeric valve and the chamber body and a product chamber between the chamber body and the chamber cap.

2. The laundry product of claim 1, wherein the dispensing ball is removably attached to the chamber body and rotation of the dispensing ball rotates the chamber body relative to the closure body.

3. The laundry product of claim 1 wherein said valve includes a conical membrane.

4. The laundry product of claim 1 wherein the dispensing system further comprises a gasket received between the chamber body and the chamber cap.

5. The laundry product of claim 1 wherein the chamber cap is snap fit to the chamber body.

6. The laundry product of claim 1 wherein the valve includes an outlet communicating with the outlet of the chamber cap and a vent seal engaging the chamber body.

7. The laundry product of claim 1 wherein the closure body includes a plug seal engaging with the container.

8. The laundry product of claim 1 wherein the closure body and the container include mating threads.

9. The laundry product of claim 1 wherein the chamber body further includes a valve post, the valve received over the valve post.

10. The laundry product of claim 1 wherein the closure body, chamber body, valve, cap and dispensing ball are coaxial.

11. The laundry product of claim 1 wherein the chamber body and the closure body each include interfitting rotatable body connections.

12. The laundry product of claim 2 wherein the chamber body and the closure body each include interfitting rotatable body connections.

13. The laundry product of claim 10 wherein the chamber body and the closure body each include interfitting rotatable body connections.

14. The laundry product of claim 9 wherein the closure body, chamber body, valve, cap and dispensing ball are coaxial.

15. The laundry product of claim 14 wherein the chamber body and the closure body each include interfitting rotatable body connections.

* * * * *